US005563578A

United States Patent [19]

Isenstein

[11] Patent Number: 5,563,578

[45] Date of Patent: Oct. 8, 1996

[54] DETECTION OF HAZARDOUS GAS LEAKAGE

[76] Inventor: Robert J. Isenstein, 107 Blossomcrest, Lexington, Mass. 02178

[21] Appl. No.: 96,310

[22] Filed: Jul. 26, 1993

[51] Int. Cl.[6] ..... G08B 19/00; G08B 17/00; G08B 17/10

[52] U.S. Cl. ..... 340/521; 340/584; 340/629; 340/633; 340/634

[58] Field of Search ..... 340/517, 521, 340/522, 577, 578, 584, 600, 628, 629, 632, 633, 634, 691, 692

[56] References Cited

U.S. PATENT DOCUMENTS

| | | | |
|---|---|---|---|
| 3,678,489 | 7/1972 | Scherban et al. | 340/633 |
| 4,088,986 | 5/1978 | Boucher | 340/634 |
| 4,423,411 | 12/1983 | van der Walt et al. | 340/629 |
| 4,550,313 | 10/1985 | Kimura | 340/584 |
| 4,847,783 | 7/1989 | Grace et al. | 340/634 |
| 5,055,269 | 10/1991 | Palumbo et al. | 340/633 |
| 5,293,155 | 3/1994 | Nicol et al. | 340/517 |

*Primary Examiner*—Safet Metjahic
*Assistant Examiner*—John W. Miller
*Attorney, Agent, or Firm*—George E. Kersey, Esq.

[57] ABSTRACT

Method and apparatus for the detecting hazardous conditions including the hazardous leakage of carbon dioxide gases by detecting spontaneously a plurality of the conditions which are encoded with a different response for each condition; for the detection of hazardous conditions associated with combustion or potential combustion, the detection is of a plurality of gaseous conditions having different chemical and thermal characteristics and the presence of each such condition is indicated; when the detection is of the leakage of fuel gases, a plurality of catalytic units is used, each having a platinum wire extending to a junction with a comparator and bridged by a detector provided with bridge balance and threshold adjustment; periodic heat cleansing is by a multi-terminal bistable oscillator; smoky carbon particles are detected by an ionization chamber connected to alarm circuitry.

20 Claims, 15 Drawing Sheets

24

33

DETECTION OF HAZARDOUS GAS LEAKAGE

BACKGROUND OF THE INVENTION

This invention relates to the detection and indication of hazardous conditions, particularly those associated with potential or actual combustion malfunctions involving the release of toxic agents, such as escaping fuel gasses and carbon monoxide, as well as excessive smoke and heat.

During and prior to combustion there can be an inadvertent and objectionable escape of fuel gases. If the combustion is incomplete, carbon monoxide can be generated, along with carbon particles that form a sooty smoke. In some cases the combustion can generate excessive heat.

Numerous devices are available for the detection of such hazards. In general the devices for gas detection are highly specialized, and often excessively complex and expensive.

One example of a specialized device for the detection of hazardous gasses is the "Battery Powered Gas Level Indicator" of U.S. Pat. No. 4,250,737 issued Feb. 17, 1981 to Timothy J. Biglin. In the '737 patent, a gas level indicator incorporates two sensing elements and a comparator for signalling a dangerous increase in gas level associated with on-site gas leaks. This device not only is limited in its capability, but also unduly complex.

Another specialized device is the "Gas Sensing Instrument" of U.S. Pat. No. 4,847,783 issued Jul. 11, 1989 to Richard Grace, et al. In the '783 patent there is programmable control over the operating temperatures of an array of gas sensors. This arrangement quantifies the concentrations of gasses in an oxygen-containing atmosphere using a computer in a complex equipment arrangement. This device also is limited in its capability.

While the quantification of gas concentration can meet specialized needs, there is a general need for merely indicating the presence of an undesirable concentration. Consequently the specialized and limited capability of this instrument is not of general utility.

A further specialized device is the "Semiconductor Gas Sensor Having Linearized Indications" of U.S. Pat. No. 5,034,725 issued Jul. 23, 1991 to Thomas C. Sorensen. In the '725 patent exhaust gases are measured and indicated by a sensor for which conductivity varies in accordance with variations in the concentration of the ambient exhaust. Like the '783 patent mentioned above, the device of patent '725 is complex and of limited applicability.

Accordingly, it is an object of the invention to facilitate the detection and indication of hazard conditions, particularly those relating to the objectionable presence of gasses and heat, particularly those conditions associated with exhausts and combustion. A related object of the invention is to provide a facility for gas, heat and smoke detection in a portable unit that is suitable for domestic as well as commercial use.

A further object of the invention is to provide a generalized detection and indication device for hazardous gasses, smoke and heat.

A further object of the invention is to achieve hazard indication in a reliable and economic way, so that the detection capability associated with complex and expensive instrumentalities can be made available to ordinary users and thus provide for enhance community security.

SUMMARY OF THE INVENTION

In accomplishing the foregoing and related objects, the invention provides for the detection of a plurality of hazardous conditions and encoding a different response, such as a different audio alarm, for each such condition. The hazards may be associated with combustion, or potential combustion, and the detection be of a plurality of conditions having different chemical and thermal characteristics, with the presence of each such condition indicated.

In accordance with one aspect of the invention, the detection is of leakage of fuel gases. Such detection can be accomplished by energized catalytic detector units, each having a platinum wire extending to a junction from which a line extends to a comparator. Resistors form a detector bridge, and a further resistive shunt provides for bridge balance and threshold adjustment. The detector bridge can be additionally shunted by a resistor within an auxiliary commutator bridge formed by diodes which are further shunted by commutator resistors. The commutator bridge acts through a steering diode with respect to a driver.

In accordance with another aspect of the invention, the detection is of leakage of carbon monoxide gases. Such detection is accomplished by a semiconductor sensor with a plurality of terminals. A filament within the sensor extending to a pair of terminals which, in turn, interconnect driver transistors. One of the driver transistors has a grounded emitter and is shunted to a collector by a current limiting resistor, with a base extending over a line to a heat cleaning timing circuit and the collector extending to a driver. The other transistor has both its emitter and base connected to a comparator and its collector connected to a bias voltage source. The semiconductor sensor has a further pair of interconnected terminals joined to a bias source and a still further pair of interconnected terminals extending to a comparator. Another terminal of the sensor is joined to a resistor to complete an internal voltage divider.

In accordance with further aspect of the invention, provision is made for periodic heat cleansing of the sensor. This can be achieved by a multi-terminal bistable oscillator connected to one driver transistor of the sensor through a resistor. The oscillator is directly grounded and further connected to ground by a capacitor. It has other terminals interconnected by a diode, directly interconnected to a bias voltage source, and interconnected thereto by a resistor and diode.

In accordance with still another aspect of the invention, the detector can further include the detection of smoky carbon particles. For that purpose an ionization chamber can be employed with a grounded cathode and a shield that is connected to a bias voltage power supply. An anode of the ionization chamber is connected to alarm circuitry.

In accordance with yet another aspect of the invention, the detector can further provide for detecting excess heating effects. This can be accomplished by a grounded temperature sensor diode shunted by an adjustable trim resistor. The temperature sensor diode has an ungrounded cathode connected to a bias voltage power supply through a resistor and to a comparator. A reference divider for comparing detected temperature voltages with a threshold trigger temperature voltage is provided by a grounded resistor joined by another resistor to the bias voltage power supply and is tapped by a comparator.

The invention additionally provides a distinctive audible alarm for each detected condition. The alarm for each detected condition can include a circuit chip which operates in conjunction with a plurality of transistors and a piezo horn with three terminals, with the plate at one terminal extending to a pin of the chip. The plate also can extend through a resistor to a pin of the chip to provide a common source for alarm signals during the detection of any one of the multiple hazards within the capability of the system. The chip provides universal detection and drives a piezo horn enunciator. Upon the occurrence of an alarm condition, the horn produces a sound signal that depends upon the condition that is detected.

Timing for the alarm can be controlled by a multiple-pin monostable pulse width generator chip, with one pin grounded and joined to another pin through a capacitor. A path from another pin extends to a comparator through a diode. Paths extend through diodes to the comparator and diodes are bridged to a pin by respective resistors. The chip serves multiple functions in the overall system and accordingly is active in conjunction with the gas and temperature sensing operations and, also, with respect to smoke detection, includes a timing resistor which interconnects terminals and is joined to a bias voltage source. The chip also has terminals interconnected and joined to an auxiliary driver. A terminal with a grounded resistor is joined to a second driver and other terminals extend to alarm circuitry. Extending from another terminal of the chip is a path to a transistor through a capacitor, with the emitter of the transistor grounded through a capacitor, and its base extending to the comparator through a resistor. Another terminal of the chip is connected to the collector of a second transistor with a grounded-emitter and a base connected to bias through a resistor and a Zener diode. Plate and cathode terminals extend to external alarm outputs.

In a method of detecting a hazardous condition, the steps include detecting a plurality of different such conditions and indicating the same.

In a method of detecting a hazardous gas leak of a household gas such as methane or propane, the steps include (a) producing a response by a catalytic unit in a bridge powered from a voltage regulator; (b) achieving bridge balance-and threshold adjustment for the catalytic unit; (c) comparing the response signal with a reference; and (d) attaining hysteresis, e.g. by the addition of positive feedback to increase the accuracy of response, in the comparator by connecting a large magnitude resistor to the comparator.

In a method for the sensing of a hydrocarbon gas the temperature of the catalytic unit increases. This causes a change in resistance, so that bridge balance is exceeded to produce a high level state driving a transistor within indicator circuitry to an "on" state through a resistor to activate a light emitting diode and extinguish an indicator diode that signals an "okay" condition. The emitter of a transistor in alarm circuitry is driven to an "on" state through diodes and a base resistor, placing the proper timing capacitance into operation, e.g. by one or more capacitors depending upon the time interval that is desired.

In a method of the invention a high state pulse is synchronized with respect to the internal timing of an LSI (Large Scale Integrated) detector chip by sampling with a negative going needle pulse that triggers a chip and produces an output pulse to operate the detector.

For a gas alarm condition, a detector produces a series of audible dashes. Heater filaments are monitored for an open circuit condition by a non-zero, positive or negative potential in relation to virtual ground. A commutator bridge formed by diodes steers either positive or negative potential through a diode to a comparator chip, and a signal is received from the commutator bridge anode. Upon detection of an open condition of a sensor heater, the comparator switches to a low voltage condition to ensure that no spurious gas alarm will sound, and a short time constant associated with series connected capacitors results in having a piezo horn sound a continuous string of audible dots.

In a method for detecting the presence of hazardous concentrations of carbon monoxide, a semiconductor sensor is employed for which a heater filament is driven by a current source. The latter formed by a reference divider at terminals of a comparator chip, and a scaler divider is formed by resistors at another terminal of the comparator chip. The output is applied to a driver transistor which is connected through heater pins to a current limiting shunt resistor for a second transistor. As a result, in the normal stand-by condition, the second transistor is "off". An internal voltage divider within the carbon monoxide detector is formed by the series combination of its substrate with an external balancing resistor. The comparator samples the voltage of the carbon monoxide detector. A hazardous level of carbon monoxide appearing at the detector then causes the substrate resistance to fall, resulting in a rise in voltage in excess of the comparator threshold and producing a high condition of the comparator chip to turn on a transistor indicator, supplying current to a carbon monoxide indicating light diode. An "okay" indicator diode is turned off by an auxiliary driver chip, and the alarm chip is then activated through a resistor and diode to activate the driver. A relay in external alarm circuitry also is activated.

In a method of the invention, a piezo horn in the alarm circuitry sounds an alarm as a series of audible dashes and periodic heat cleansing of semiconductor sensors is made to avoid spurious alarms from foreign gases accumulating on their surfaces. Burn-off of spurious gasses is by a bistable oscillator formed by a chip to drive a transistor in heat detection circuitry through a resistor and by-pass a shunting current limiting resistor. This increases the current through the sensor heater for approximately one minute every hour.

The heaters are monitored for an open circuit condition by comparing a sample of heater voltage with the voltage on a reference divider. Upon the occurrence of a "zero" voltage condition, an internal amplifier pulls a chip to a low voltage condition in order to prevent a false carbon monoxide alarm, and there is a low voltage because of a signal applied through a diode to illuminate a trouble indicator light diode and extinguish an "ok" condition diode.

In the method of the invention, during the heating cycle, the heater sampling point is pulled to a zero voltage level. In order to suppress a false trouble detection alarm, a potential from a bistable oscillator is injected into a trouble detection comparator to prevent tripping.

Where a test function switch is included for a carbon monoxide alarm, there is injection of divider voltage from tapped, series connected resistors into the comparator chip to perform in the manner for the hazardous gas detection test.

To provide smoke detection, the detector employs a chip which operates in conjunction with an ionization smoke chamber, with internal timing for the detector chip set by a resistor which operates in either a rapid time constant or a long time constant mode. For the rapid time constant mode, a resistor is joined to the series combination of capacitors which applies during normal stand-by and trouble conditions.

For the long time constant, the resistor is connected to a single capacitor and then through a grounded-emitter transistor during periods of gas, carbon monoxide, heat and smoke alarm conditions, with the voltage in the detector chip decreasing linearly in accordance with the volume of smoke detected.

In a method of the invention an alarm threshold, normally performed internally by an auxiliary integrated circuit, is detected by a main integrated circuit and the threshold divider is formed by resistors. A test function switch, when closed, causes the quiescent voltage of a detector chip to drop to a level just below threshold, through a divider network formed by resistors which are connected to the auxiliary comparator chip. In either the test mode or the alarm mode the chip switches to a high voltage level and drives a smoke detection light emitting diode to its "on" condition. Simultaneously, a signal level of the chip drives an internal buffer through a diode to a transistor in the smoke detector to saturation, producing an output which drives an alarm relay in an external alarm output unit. When the threshold of a divider formed by resistors is reached, the output from an internal amplifier reaches a low state and the "ok" light emitting diode is extinguished. The enunciator piezo horn then produces a continuous string of audible dashes.

Within the comparator chip, the voltage from a transistor through a resistor and diode can cause the detector chip to be turned off when the supply voltage falls below a prescribed level in relation to the power supply direct current drive in order to suppress spurious alarm soundings if the alternating current input voltage falls.

In a method for heat sensing employing a precision temperature sensor, grounded Zener diode receives a regulated voltage from a power supply applied to the anode of the Zener diode through a current limiting resistor and is calibrated for ambient conditions by a shunt a resistor with an adjustable tap. When the output to the auxiliary comparator driver exceeds the threshold established at a reference divider formed by resistors, the auxiliary comparator reaches a high voltage state to produce the following results: an excess-heat indicating-light diode is driven to its "on" condition; an "ok" condition light diode turns off; a transistor in alarm circuitry is turned "on" to select a long time constant of a single capacitor and resistor through diodes; the alarm chip is activated to produce a signal which activates the driver chip and energize a relay and the piezo horn sounds an alarm as a continuous string of audible dashes.

In a method of providing a common source for alarm signals during the detection of any one of the multiple hazards within the capability of the system, a universal detection chip drives a piezo horn enunciator and upon the occurrence of an alarm condition, the horn produces a sound signal that depends upon the condition that is detected.

In apparatus of the invention the detectable conditions include gas sensing, smoke sensing and temperature sensing. Means are provided for detecting hazardous gasses, the presence of smoke, and excess heat; as well as means for indicating the absence of a hazard, means for disabling the hazard absence indicator and activating an indicator for each detected hazard.

The means for detecting hazardous conditions include means for detecting the presence of carbon monoxide and means for periodically cleaning the detecting means to eliminate nuisance gases.

DESCRIPTION OF THE DRAWINGS

Other aspects of the invention will become apparent after considering several illustrative embodiments, taken in conjunction with the drawings, in which:

FIG. 2B-2 is a schematic diagram of cleansing circuitry for the carbon oxide detector of FIG. 2B-1.

DETAILED DESCRIPTION

A. System Overview

Figure 1A:
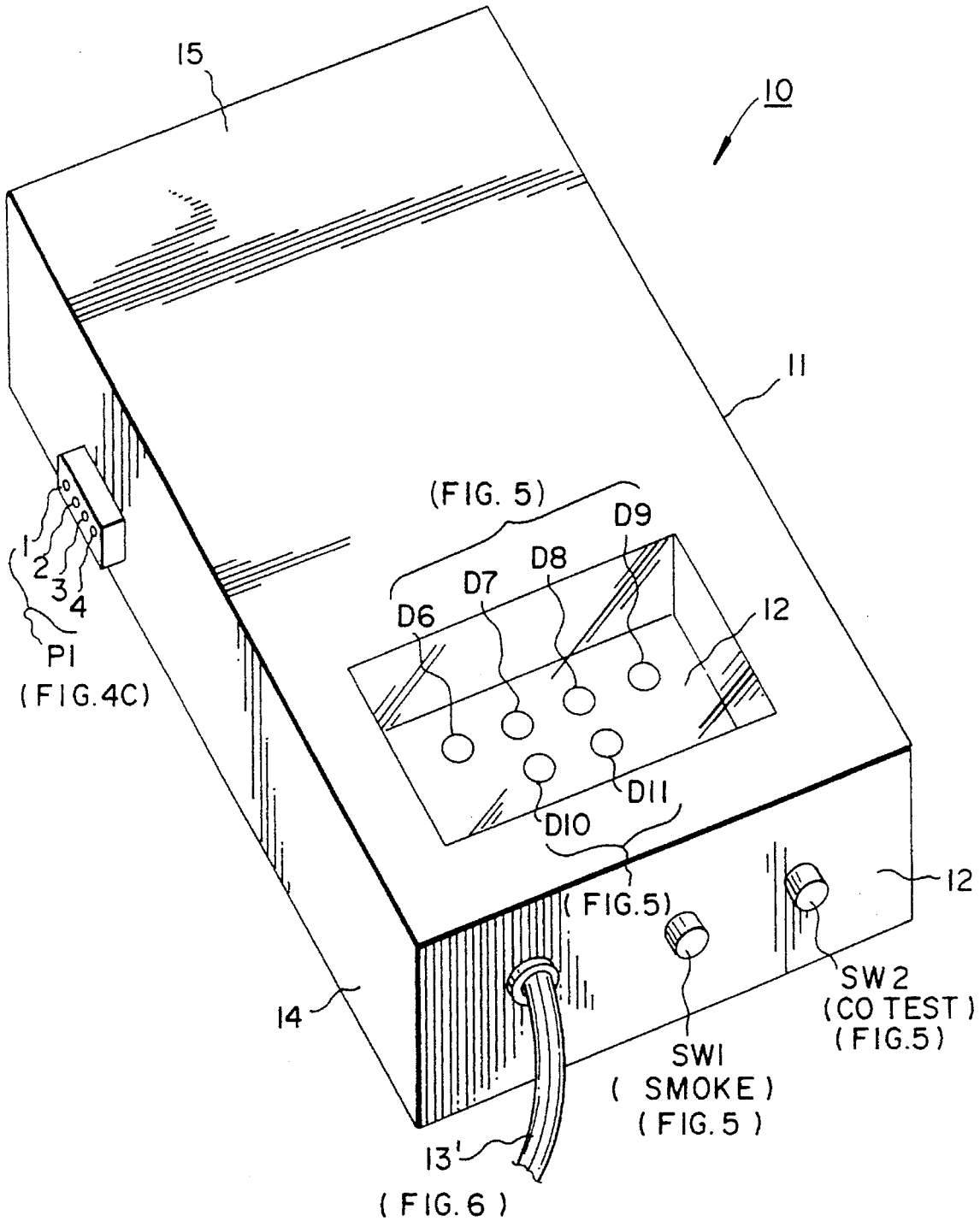
FIG. 1A is a perspective view of a multi-purpose hazard detection system in accordance with the invention.

With reference to the drawings, a perspective overview of a hazard detection system 10 in accordance with the invention is shown in FIG. 1A. The system 10 is encased within a housing 11 that has a recessed compartment 12 in an upper panel 15. The recessed compartment 12 contains light-indicating diodes (LED's) D6 through D11. The front 13 of the housing 11 includes a cord 13' for connection of the system 10 to an external power source, such as standard 110 volts alternating current. The front 13 also includes test switches SW1 and SW2, respectively for smoke and carbon dioxide. The side panel 14 has an accessory plug P1 with alarm relay output pins 1 and 2, and external piezo alarm pins 3 and 4. Include in the side panels, of which only the side panel 14 is visible in FIG. 1A, are vents V, which also are included in the upper panel 15.

Figure 1B:
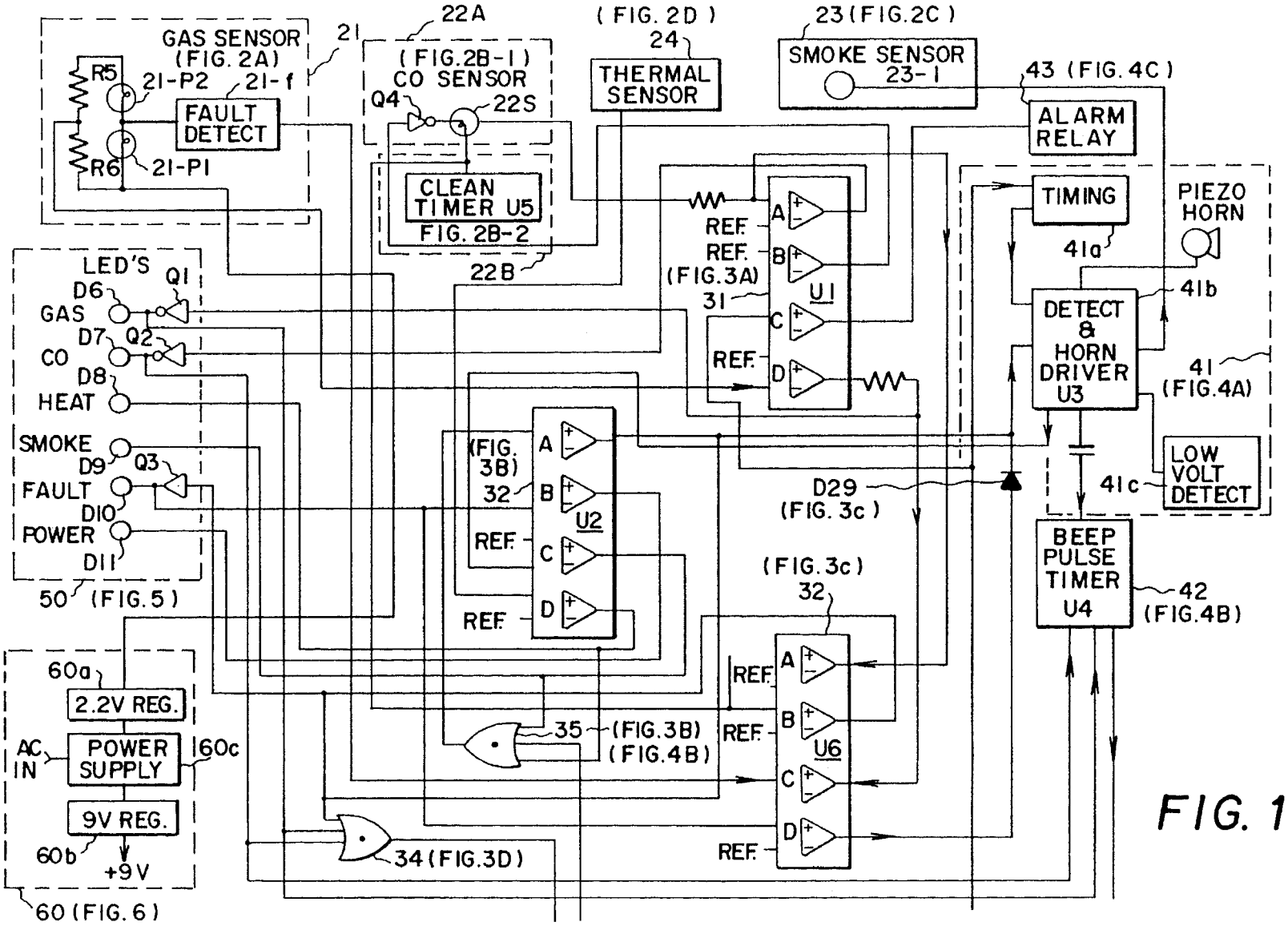
FIG. 1B is a block diagram of a multi-purpose hazard detection system in accordance with the invention.

A block diagram of the system 10 is set forth in FIG. 1B. The system 10 is formed by four primary detecting units 21–24, which are integrated with the remainder of the system as described below.

Figure 2A:
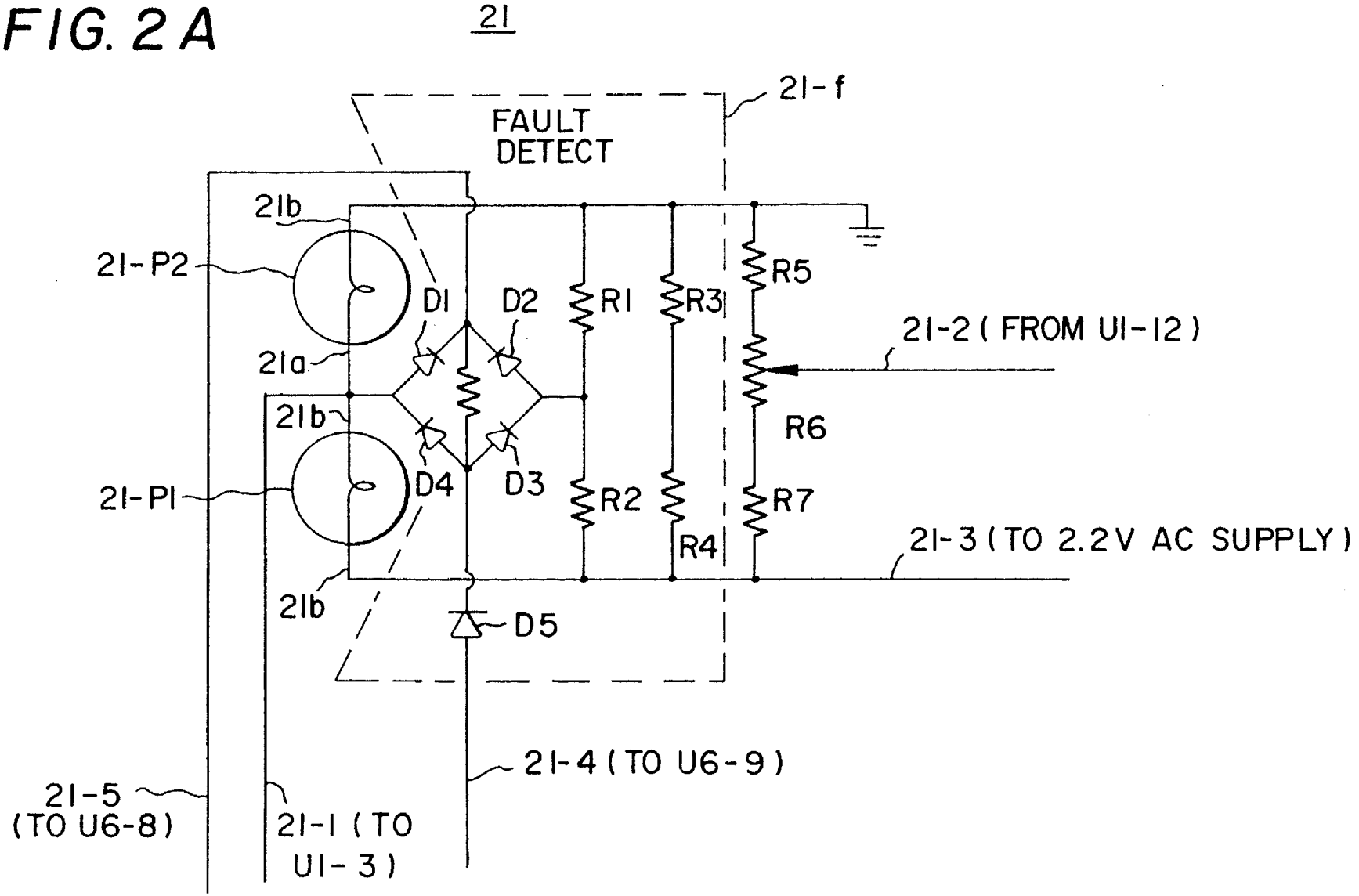
FIG. 2 is a set of schematic diagrams for the hazard detection block components of FIG. 1, including FIG. 2A which is a schematic diagram for the hazardous hydrocarbon gas detection component 21 of FIG. 1.
FIG. 2B-1 is a schematic diagram for the hazardous carbon oxides detection component of FIG. 1.
FIG. 2C is a schematic diagram of the smoke detection component 23 of FIG. 1
FIG. 2D is a schematic diagram of the heat detection component 24 of FIG. 1.

The unit 21, which is described in detail in conjunction with FIG. 2A, is for the detection of hazardous hydrocarbon gasses, such as the leaks found around the equipment used in the combustion of hydrocarbon gases, including methane and propane.

Figure 3A:
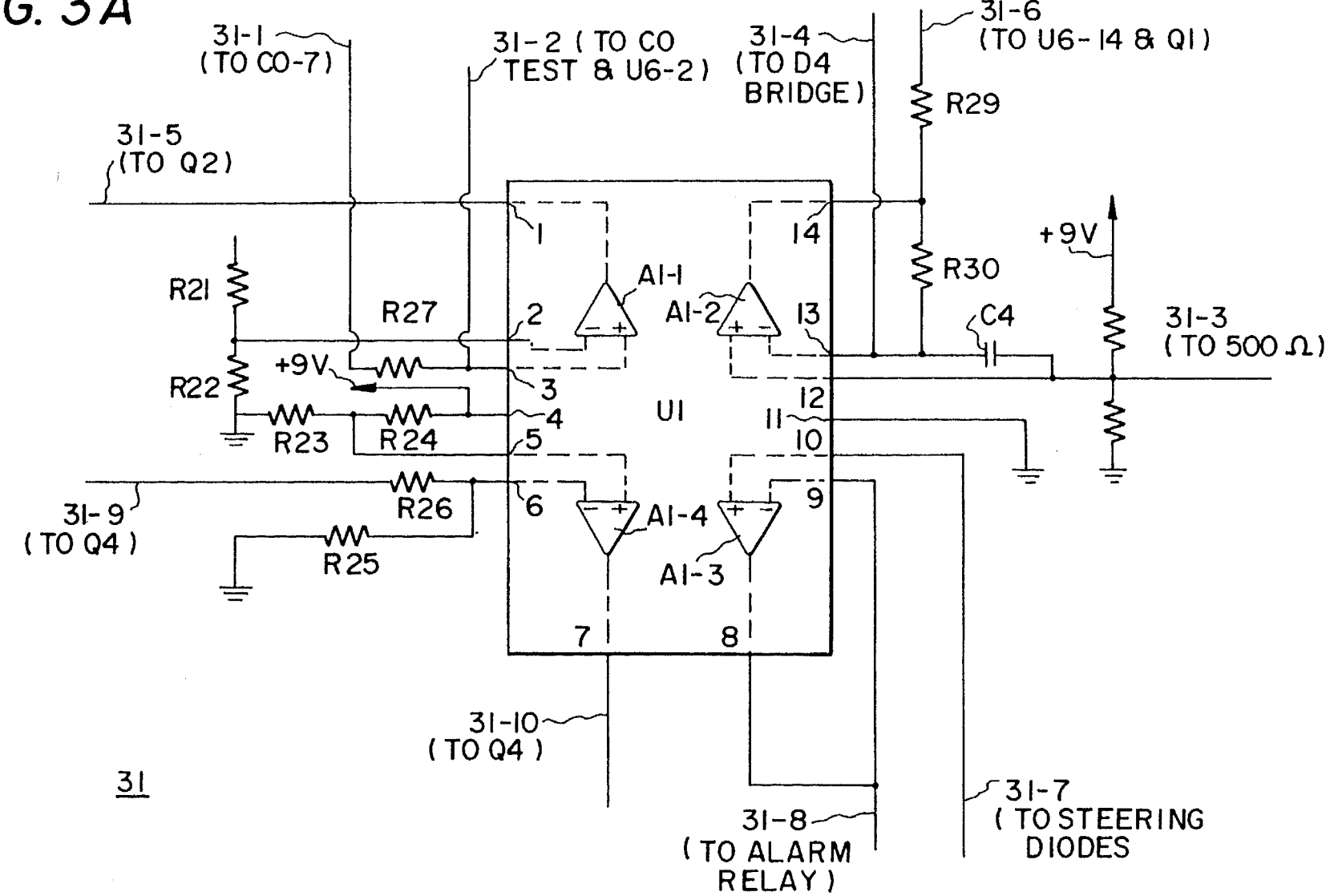
FIG. 3 is a set of schematic diagrams for comparators and drivers used in conjunction with the hazard detection components of FIG. 2, including FIG. 3A which is a schematic diagram of the main comparator 31 circuitry for the components of FIG. 2.
FIG. 3B is a schematic diagram of the auxiliary comparator or driver 32 circuitry for the components of FIG. 2.
FIG. 3C is a schematic diagram of the second auxiliary comparator or driver 33 circuitry for the components of FIG. 2
FIG. 3D is schematic diagram of steering diodes used with the comparator-drivers of FIG. 3.
Figure 3B:
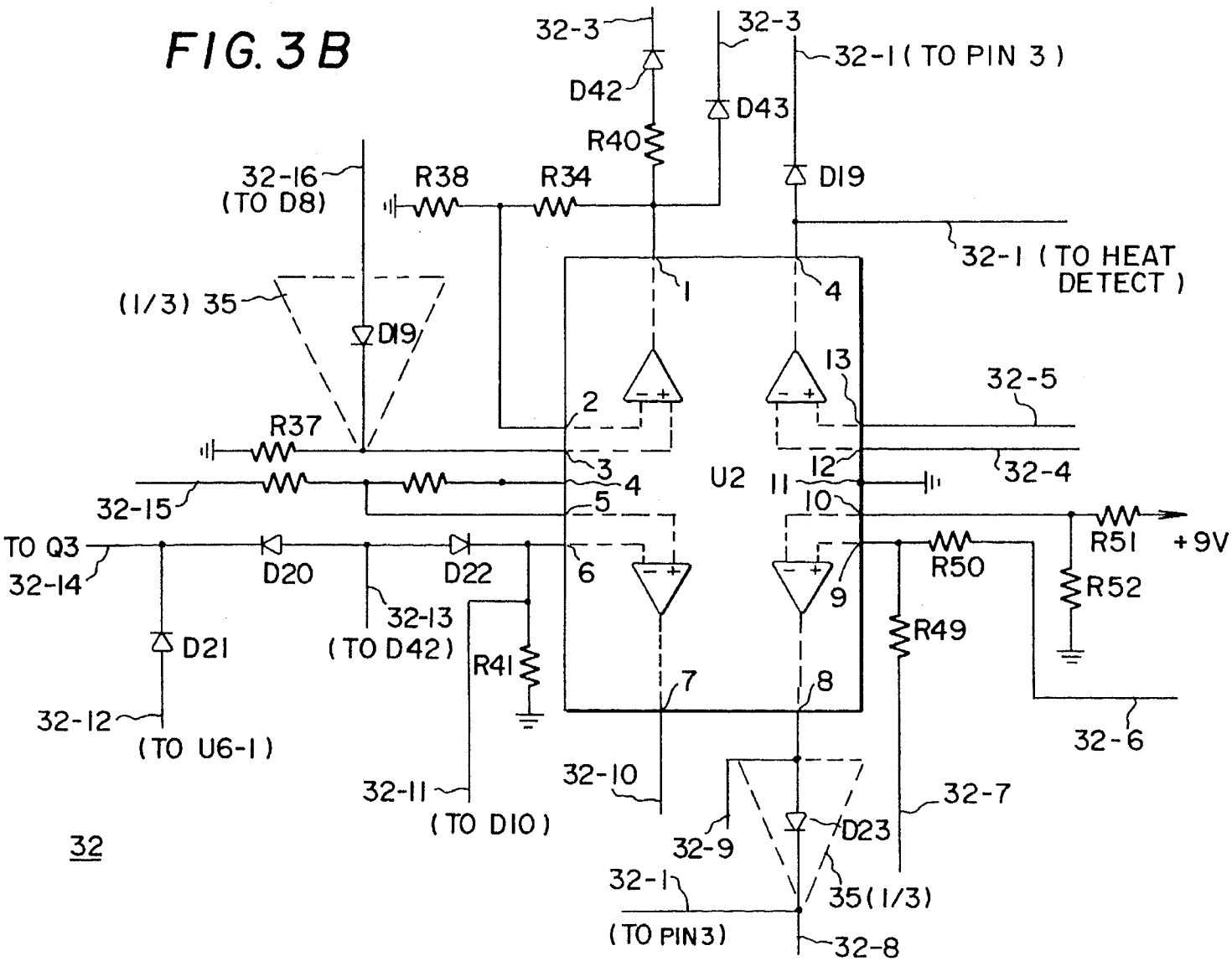
Figure 3C:
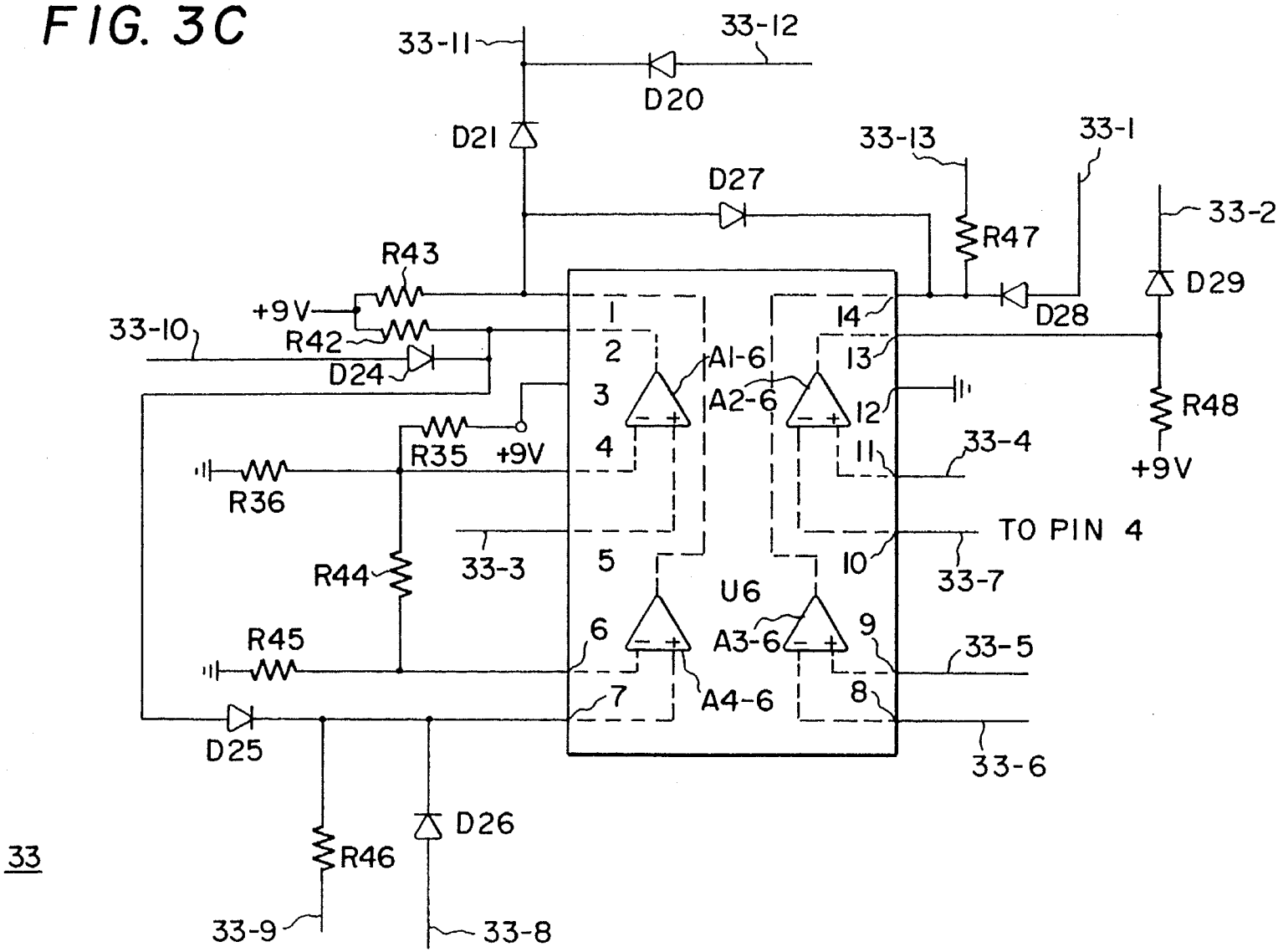

As indicated in FIG. 1B, the hazardous gas detector 21 acts with respect to comparator-drivers 31 and 33, detailed in FIGS. 3A and 3C.

Figures 1, 2B:
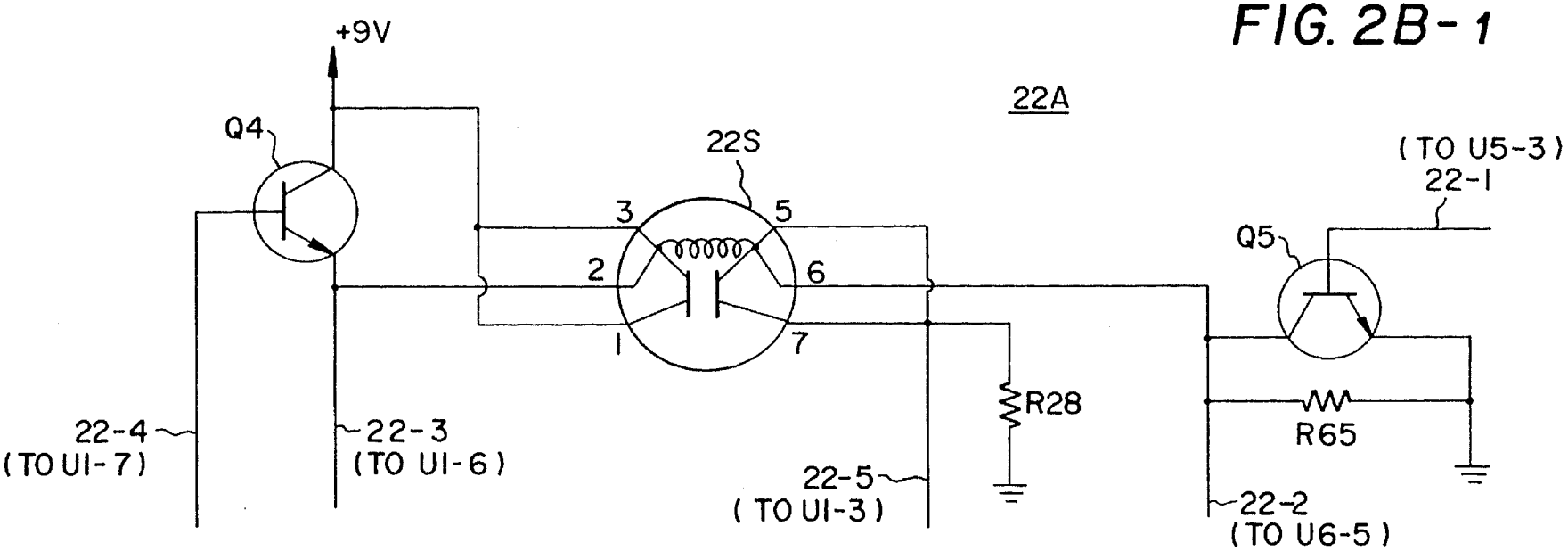
Figure 2C:
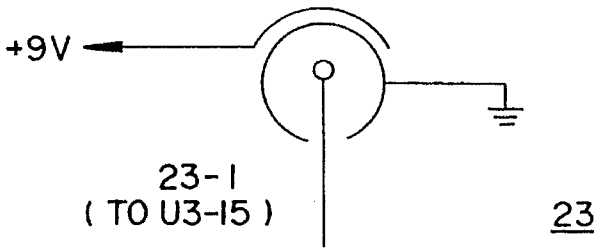
Figures 2, 2B:
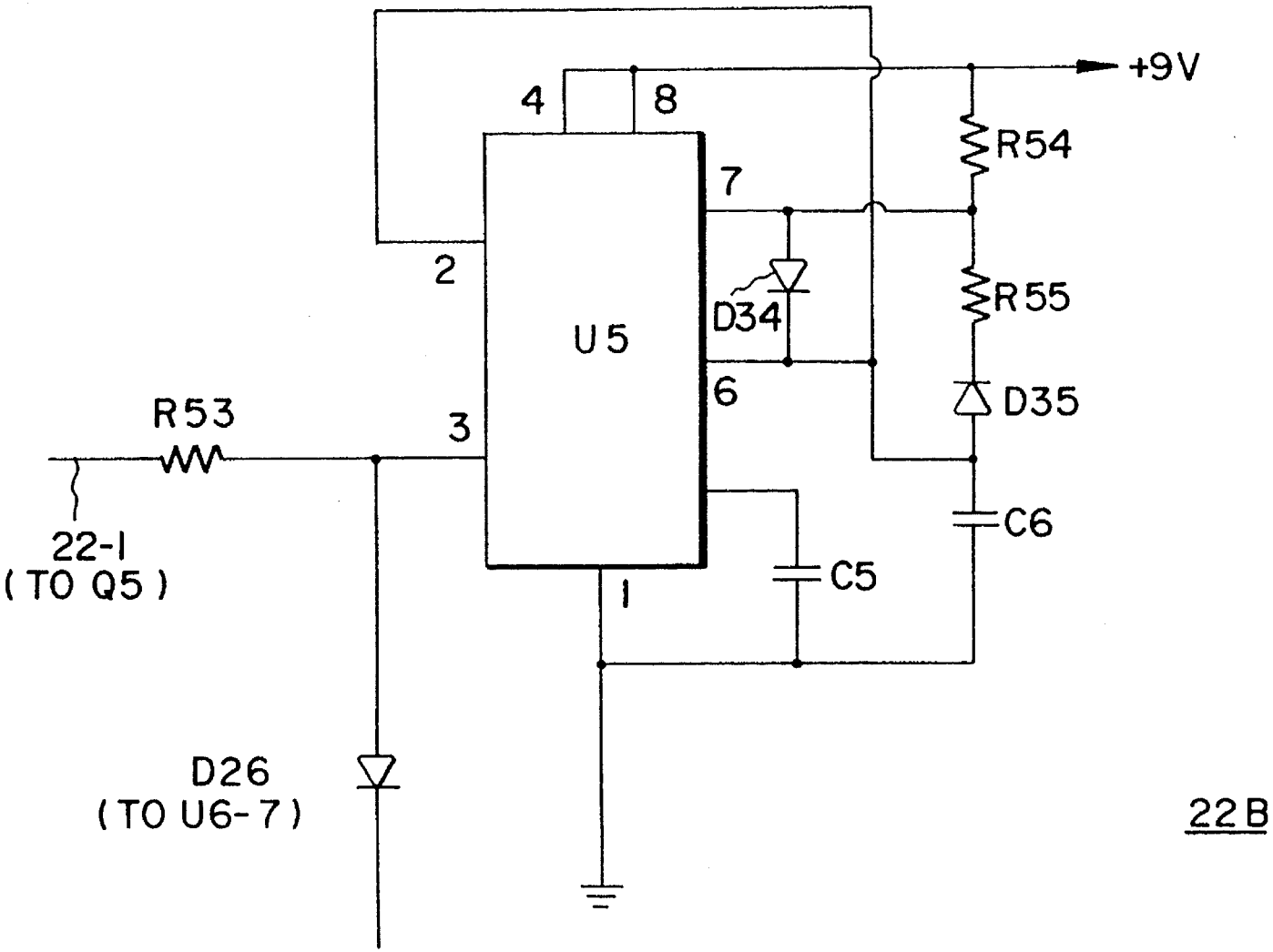

The unit 22, which is described in detail in conjunction with FIG. 2B-1 and 2B-2, is for the detection of hazardous carbon oxide gasses, such as carbon monoxide associated with exhausts and combustion leaks. The hazardous gas detector 22 also acts with respect to the comparator-drivers 31 and 33.

The unit 23, which is described in detail in conjunction with FIG. 2C, is for the detection of excessive particulate carbon in the form of smoke. The unit acts in conjunction with the comparator-driver 32 detailed in FIG. 3B and the alarm unit 41 of FIG. 4A.

Figure 2D:
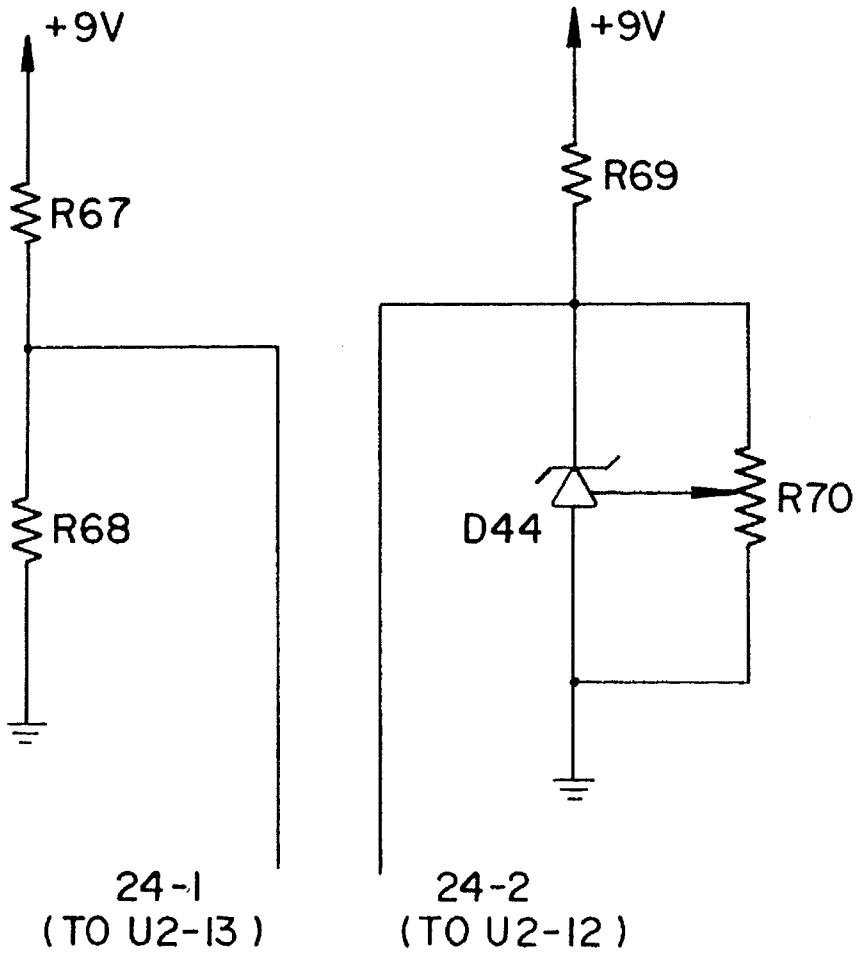

The unit 24, which is described in detail in FIG. 2D, is for the detection of excessive temperatures associated with combustion. As indicated in FIG. 1, the unit 24 acts in conjunction with the comparator-driver 32 detailed in FIG. 2B.

Figure 4A:
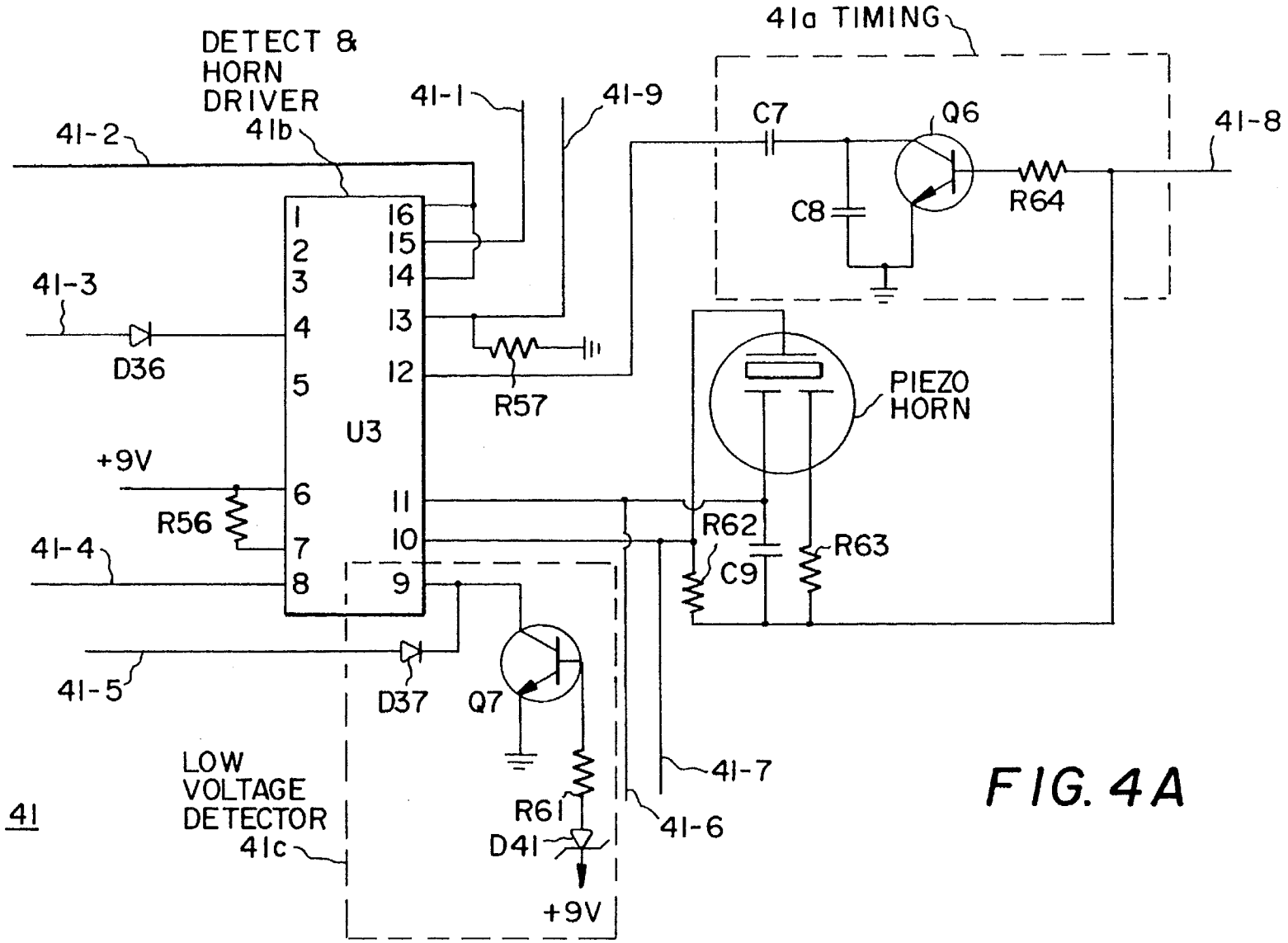
FIG. 4 is a set of schematic diagrams for alarm circuitry used in conjunction with the comparator-drivers of FIG. 3, including FIG. 4A which is a schematic diagram for the main alarm components.
FIG. 4B is a schematic diagram for the driver circuitry for the alarm components of FIG. 4A.
FIG. 4C is a schematic diagram of external alarm circuitry for the alarm components of FIG. 4A.
Figure 4B:
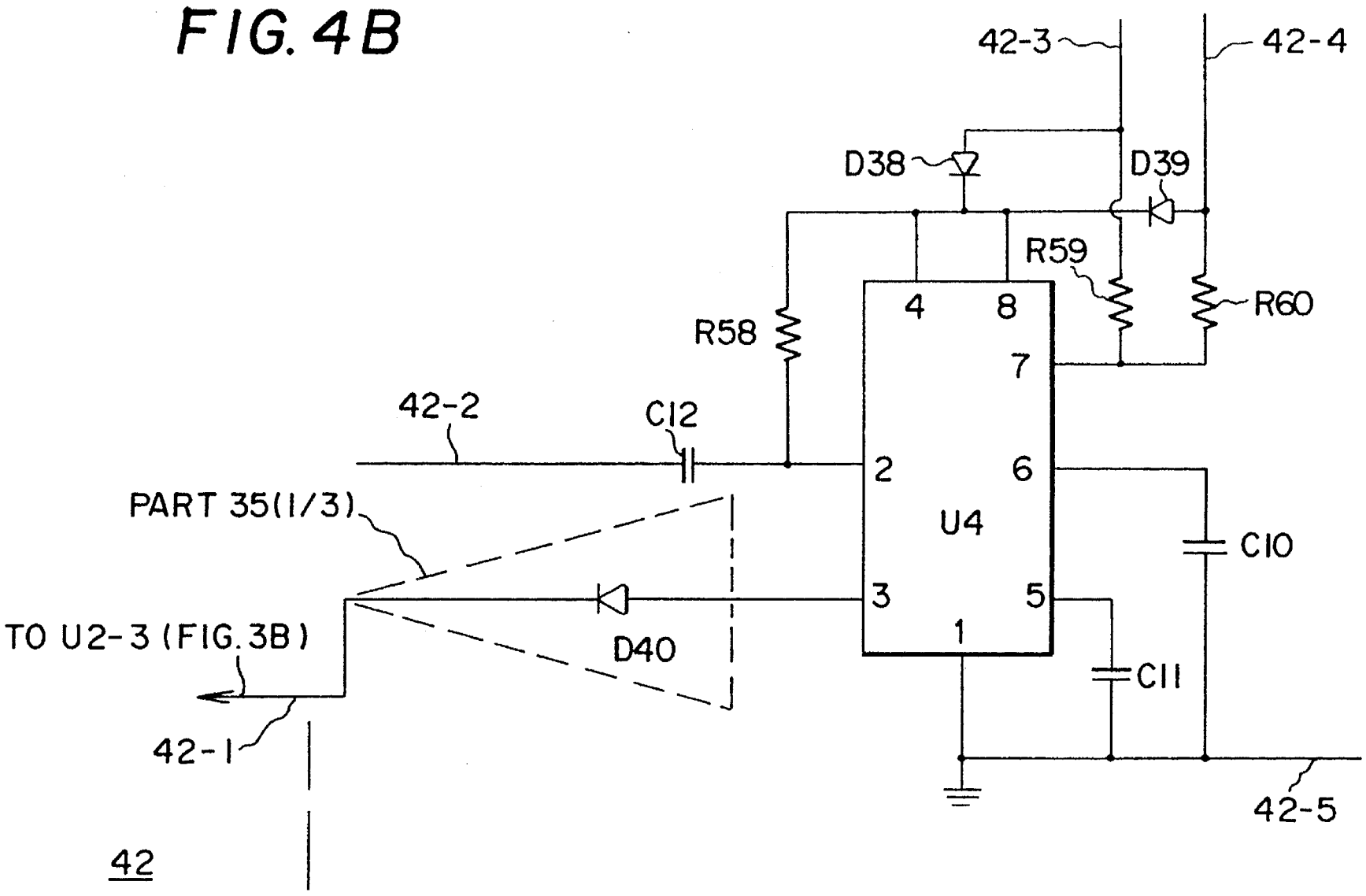
Figure 4C:
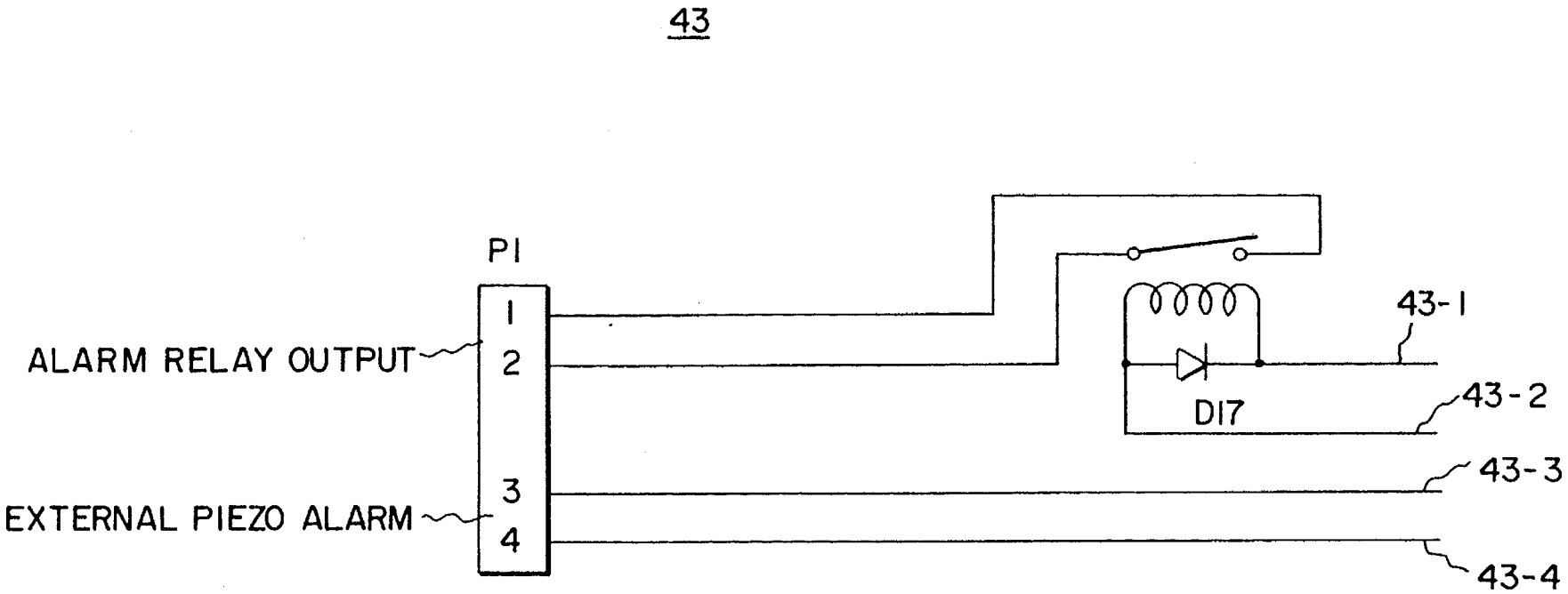
Figure 5:
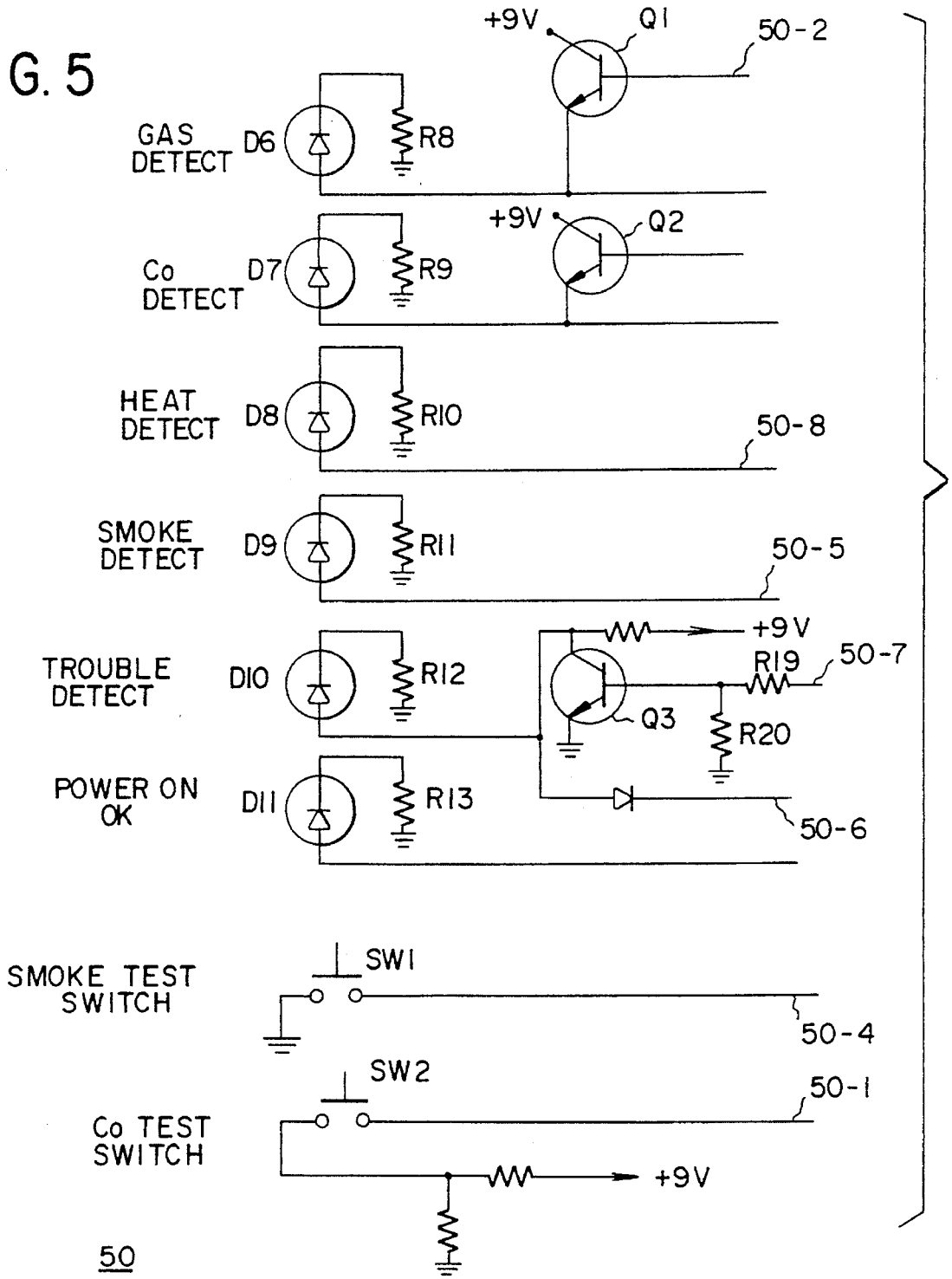
FIG. 5 is a schematic diagram of the indicator and test circuitry for the components of FIG. 2.

In order to integrate the various detection functions in an efficient fashion that can result in an overall system in which redundant components are eliminated, and the overall detection functions are performed in a cost-effective fashion, the various detecting units 21–24 are not only operated in conjunction with the various comparators 31–33, and steering diodes 34, the comparators act upon the alarm units 41–43, detailed in FIGS. 4A–4C, but also the indicator and test circuitry 50 of FIG. 5.

Figure 6:
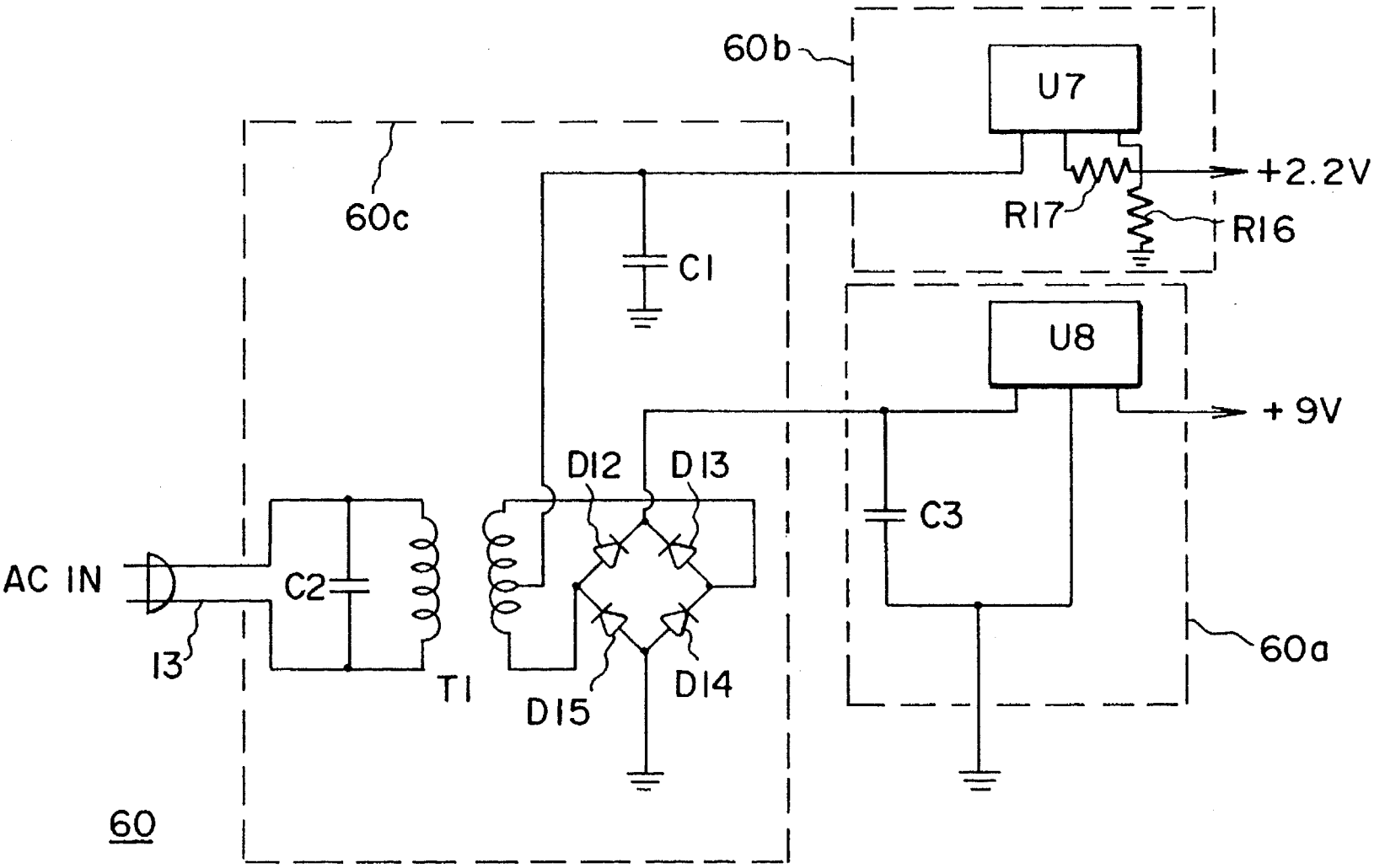
FIG. 6 is a schematic diagram of the power supply circuitry 60 for the system of FIG. 1.

The entire system 10 is energized by the power supply 60 of FIG. 6, providing both alternating current voltages and direct current power for the system 10.

When a hazard condition is detected, the alarm units 41 and 42 are activated, and external alarm outputs are available through the unit 43. Indications of the statuses of the various detection components 21–24 are provided by the indicator circuitry 50 detailed in FIG. 5.

In the description below, the structure of the various constituents for the system 10 is first described, followed by an explanation of the operation of the various units within the system 10 with reference to the structural organization of the various constituents.

B. The Detectors

(1) The Hydrocarbon Gas Detector 21

The hydrocarbon gas detector 21, shown in FIG. 2A, includes platinum wire units 21P-1 and 21P-2. Each of the units 21P-1 and 21P-2 is formed by a platinum wire with terminals **21*a* and 21*b* extending from within an envelope 21*e*. The terminal 21*b* of the unit 21P-1 is joined to the terminal 21*a* of the unit 21P-2 and a line 21-1 extends from the junction of units 21P-1 and 21P-2 to a main comparator 31 (FIG. 3A**) as described below.

Bridging the units 21P-1 and 21P-2 are detector bridge resistors R3 and R4. The terminals **21*a* of the unit 21P-1 and 21*b* of the unit 21P-2 are energized on a line 21-3 from a source of regulated direct current voltage within the power supply 60 as described below, with the terminal 21*a*** grounded.

A further shunt path, with a fixed resistor R5, tapped resistor R6 and a fixed resistor R7, is provided for bridge balance and threshold adjustment. The detector bridge is additionally shunted by a resistor R66 within an auxiliary commutator bridge formed by diodes D1 through D4, which are in turn shunted by commutator resistors R1 and R2. The commutator bridge acts through a steering diode D5 with respect to a driver 33 of FIG. 3C through leads 21-4 and 2-15, as described below.

While the hydrocarbon gas detector 21 is particularly suitable for the detection of hazardous concentrations of methane (CH4) and propane (C3H8) it can be used for other hydrocarbon gases.

(2) The Carbon Oxides Gas Detector 22

As shown in FIG. 2B-1, the carbon monoxide detector 22 includes a semiconductor sensor 22S with terminals s-1 through s-7. A filament **21*f* within the detector 22S extends to terminals s-2 and s-6 which, in turn, interconnect driver and sink transistors Q4 and Q5, respectively. The sink Q5 has a grounded emitter and is shunted by a current limiting resistor R65. The base of the transistor Q5 extends over a line 22-1 to a heat cleaning unit 22H of FIG. 2B-2, as described below, while the collector has a line 22-2 extending to the driver 33 of FIG. 3C** as described below.

The transistor Q4 has both its emitter and base connected to the main comparator 24 by lines 22-3 and 22-4, and its collector is connected to a bias voltage furnished by the power supply 60. The semiconductor 22S has its terminals s-1 and s-3 interconnected and joined to the bias supply while terminals s-5 and s-7 are also interconnected with a line 22-5 extending to the main comparator 31 of FIG. 3A. The terminal s-7 is further joined to a resistor R28 to complete an internal voltage divider of the sensor 22S.

In order to accomplish periodic heat cleansing of the sensor 22S, a bistable oscillator chip U5 of FIG. 2B-2 is connected to the current sink transistor Q5 through a resistor R53, and the chip U5 is grounded at pin 1, with pin 5 connected to ground by a capacitor C5, pins 6 and 7 interconnected by a diode D34 with the anode at pin 7, pins 4 and 8 directly interconnected to the bias voltage which is, in turn, joined to pin 7 through resistor R54, pins 7 and 6 are interconnected by resistor R55 and diode D35, pin 6 is connected to ground through capacitor C6 and pins 2 and 6 are directly interconnected.

While the carbon monoxide detector is primarily suitable for detecting hazardous concentrations of that gas, it can be used for detecting other hazardous carbonated gasses.

(3) The Smoke Detector 23

A third type of detection that is coordinated with the various comparators and drivers 31–34 of FIG. 1 is provided by the smoke detector 23 of FIG. 2C. The smoke detector 23 employs an ionization chamber 23I with a grounded cathode **23*k* and a shield 23*s* that is connected to a bias voltage from the power supply 29. The anode 23*a* of the chamber 23I is connected by a line 23-1 to an integrated circuit U3 at terminal 15 in the alarm circuitry 41 of FIG. 4A**.

(4) The Heat Detector 24

Another type of detection that is coordinated with the various comparators and drivers 31–34 of FIG. 1 is provided by the heat detector 24 of FIG. 2D. The heat detector is formed by a grounded temperature sensor D44, illustratively a Zener diode, which is shunted by an adjustable trim resistor R70. The ungrounded cathode of the diode D44 is connected to the bias supply voltage through a resistor R69, and to the comparator 32 of FIG. 3B over a line 24-2. A reference divider for comparing the detected temperature with the threshold trigger temperature is formed by a grounded resistor 68 which is joined by a resistor 67 to the bias supply and the series connected combination of the resistor R67 and R68 are tapped by a comparator line 24-1.

C. The Comparator-Drivers (1) The Main Comparator 31

The main comparator 31 of FIG. 3A is formed by an integrated circuit chip U1, such as the quad unit containing 4 differential amplifiers, A1-1 through A1-4. The amplifier A1-1 is activatable at its positive internal terminal at chip pin 3 from the gas detection unit 22 over line 31-1 (joined to line 22-5 of FIG. 2B-1) through a resistor R27, and from the line 31-2 to line 60-1 of the carbon monoxide test switch SW-2 of FIG. 6. The negative internal terminal of the amplifier A1-1 is connected to divider resistors R21 and R22.

The internal positive terminal of amplifier A1-2 extends at external pin 12 to divider resistors R31 and R32, which interconnect ground with the bias supply, and then over line 31-3 to the center tap on line 21-2 in FIG. 2A of the adjustment resistors for the gas detector 21. Pin 12 bridges to pin 13, which extends over line 31-4 to the junction of diodes 21-p1 and 21-p2 on line 21-1 in FIG. 2A. Terminal 13 is bridged by resistor R30 to output pin 14 which extends over line 31-5 through resistor R29 to the line 60-2 in the indicator circuitry 60, and, over line 31-6, to the driver auxiliary comparator 33 of FIG. 3C over line 33-1.

Figure 3D:
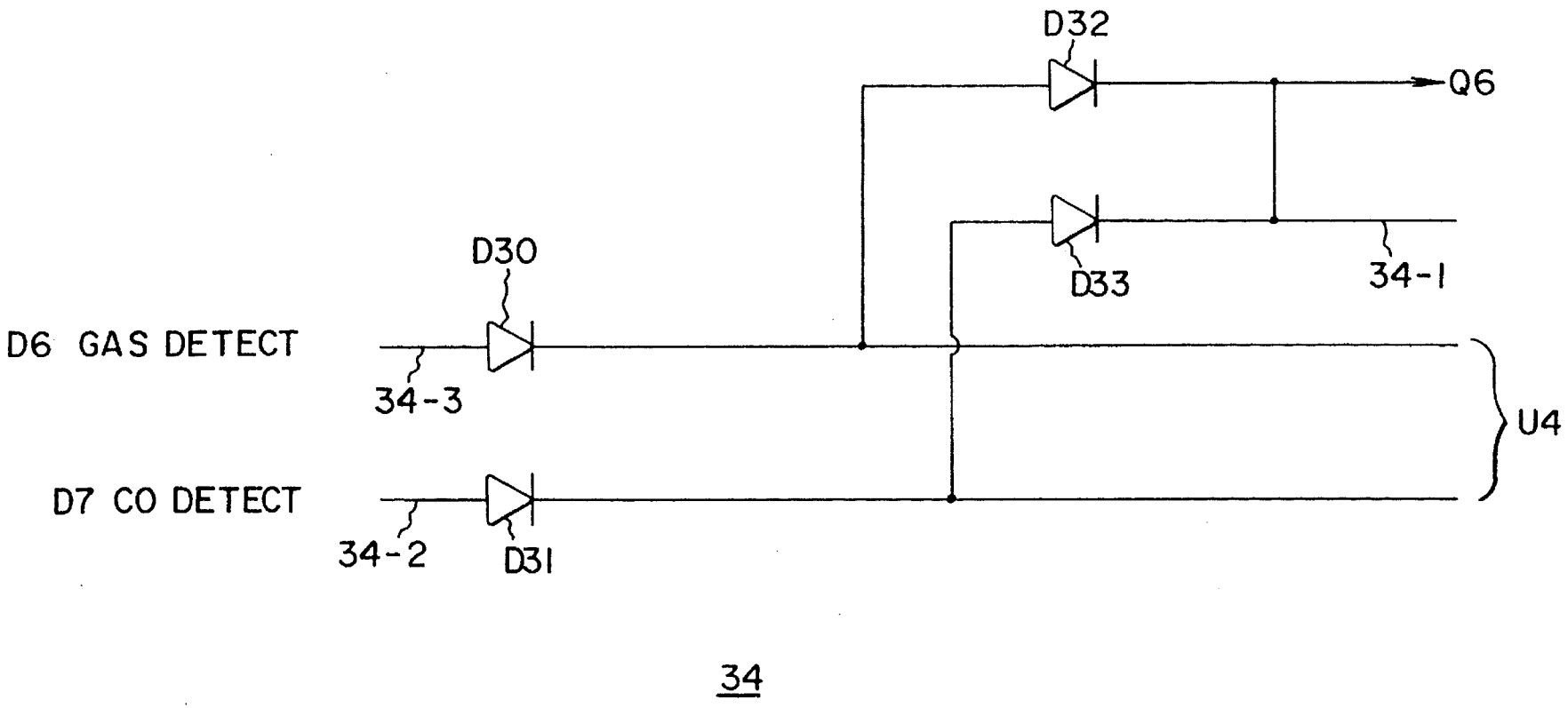

The internal positive terminal of amplifier of A1-3 is activated over line 31-7 at pin 10 from the steering diodes 34 of FIG. 3D over line 34-1, while the internal negative terminal at pin 9 and the output at pin 8 extend over line 31-8 to the external alarm output of FIG. 4C over line 43-1. The final amplifier A1-4 has its internal positive terminal at pin 5 joined to the grounded divider arrangement of R23 and R24, with the latter joined to pin 4 and the bias supply. The negative internal terminal at pin 6 is grounded through resistor R25 and extends through resistor R26 over line 31-9 to the carbon monoxide detector 22 of FIG. 2B-1 over line 22-3. The output of amplifier of A1-4 at pin 7 extends over line 31-10 to the transistor Q4 of the gas detector 21 at line 22-4 in FIG. 2B-1.

(2) Second (Auxiliary) Comparator

The auxiliary comparator or driver 32 of FIG. 3B includes an integrated circuit chip U2, such as the quad unit designated "Lm324" and also with 4 internal amplifiers A2-1 through A2-4.

The positive internal terminal of the amplifier A2-1 extends over line 32-1 through a diode D19 by way of a grounded resistor R37 at pin 3 to line 60-3 in the Detector of FIG. 6. The negative internal terminal at pin 2 is connected to a grounded resistor R38 and extends through a resistor R39, at pin 1, over line 32-2 through a diode D43 to the pin 13 of the alarm chip U3 in FIG. 4A over line 41-1 and driver chip U6 at pin 13 over line 33-2 in FIG. 3C. From pin 1 there is a path 32-3 through resistor R40 and diode D42 to the junction of diodes D32 and D33 in FIG. 3D.

The positive and negative internal terminals of amplifier A2-2 at pins 12 and 13 extend over lines 32-4 and 32-5 to the heat detector 24 of FIG. 2D at lines 24-1 and 2422, while the output at pin 14 extends over line 32-1 to line 60-3 of the indicator circuitry 60.

Amplifier A2-3 has its positive internal terminal at pin 10 joined to grounded divider resistors R51 and R52 which are provided with bias from the supply 29. The internal negative terminal at pin 9 extends through resistor R50 over line 32-6 to pins 14 and 16 of the alarm chip U3 in FIG. 4A over line 41-2, and over the line 32-7 through a resistor R49 to the smoke test switch SW1 of FIG. 6 over line 60-4. The output at pin 8 extends jointly over lines 32-8 and 32-9 to line 42-1 of the alarm multivibrator circuitry 42 of FIG. 4B, and to line 60-5 of the indicator circuitry 60 in FIG. 6.

The amplifier A2-4 has its positive internal terminal at pin 5 extending to a grounded divider resistor R34 which in turn is connected to bias through a resistor R33. The negative terminal at pin 6 is supplied through a diode D22, as well as through a grounded resistor R41. The diode D22 has a path 32-10 extending to diode D42 as well as to a steering diode D20 that extends over path 32-11 to line 60-6 in the indicator circuitry of FIG. 6.

(3) The Auxiliary Comparator-Driver

Like the main and first auxiliary comparators 31 and 32, the second auxiliary comparator of FIG. 3C has a chip U6 with four internal amplifiers.

The amplifier A6-1 has its internal negative terminal at pin 4 connected to a grounded divider resistor 36 which is in turn biased through resistor R35. A path from pin 4 also extends to pin 6 through a resistor R44. The positive internal terminal at pin 5 extends over a line 33-3 to the gas detector 22 of FIG. 2B-1 at line 22-2 . The output at pin 2 has a path through a diode D24 to the test switch SW2 at line 60-1 in FIG. 6 and is connected to bias through resistor R42. A further path extends through diode D25 to pin 7.

Amplifier A6-2 has its negative internal terminal at pin 10 connected to pin 4. The internal positive terminal at pin 11 extends over line 33-4 to the indicator circuitry 60 at line 60-6. The output at pin 13 is connected to bias through a resistor R48 and through a diode D29 over a line 33-2 to U3 pin 13 (FIG. 4A) and U2 pin 1 (FIG. 3B).

Amplifier A6-3 has its positive and negative internal terminals at pins 8 and 9 connected over lines 33-5 and 33-6 to the hazardous gas detector 21. The output at pin 14 extends to the gas detector 21 through a diode D28 and is biased through a resistor R47. Pin 14 is interconnected with pin 1 through diode D27.

Amplifier A6-4 has its output at pin 1, which is biased through resistor R43 and has a path extending to auxiliary detector 32. The input at pin 6 is connected to pin 4 through a resistor R44 and is grounded through a resistor R45. The input at pin 7 is grounded through a resistor R46 and is connected to the gas detector 21 through a diode D26.

(4) The Steering Diodes

The steering diodes D30–D33 of the unit 34 in FIG. 3D. The comparators U1, U2 and U6, and the transistor Q6 of FIG. 4A are separately driven through diodes D30 and D31 with respect to the indicator circuitry of FIG. 6, while the multivibrator U4 is connected directly to the diodes D30 and D31.

D. The Alarm Circuitry (1) The Alarm Unit

The alarm unit 41 includes a circuit chip U3 which operates in conjunction with transistors Q6 and Q7 and a piezo horn 41H with 3 terminals p-1 through p-3. The plate at terminal p-3 extends to pin 10 of the chip U3 associated with the smoke detector 23. The plate also extends through a resistor R62 to pin 8 of chip U3.

This provides a common source for alarm signals during the detection of any one of the multiple hazards within the capability of the system 10, the alarm unit 41 includes a universal detection chip U3, such as the chip "MC14467". Chip U3 drives of a piezo horn enunciator 41H. Upon the occurrence of an alarm condition, the horn 41H produces a sound signal that depends upon the condition that is detected. Cathode terminal p-1 is connected to pin 11 and to pin 8 through a capacitor C9. Cathode pin p-2 is connected to pin 8 through a resistor R63.

(2) Alarm Timing

Timing for the alarm unit 41, during period of gas or carbon dioxide detection, is controlled by a monostable pulse width generator chip U4. Pin 1 is grounded and joined to pin 5 through a capacitor C11. A path from pin 3 extends to the auxiliary comparator 25 through a diode D40. Pin 2 is connected to pin 4 through a resistor R58 and to the detector chip U3 through a capacitor C12. Pin 8 is connected to pin 4 and paths extend through diodes D38 and D39 to the auxiliary comparator 25. These diodes are bridged to pin 7 by respective resistors R59 and R60. Pin 7 is joined to pin 6 and the latter is grounded through capacitor C10.

The chip U3 serves multiple functions in the overall system 10 and accordingly is active in conjunction with all sensing operations of the system 10. It includes a timing resistor R56 which interconnects terminals 6 and 7, and is joined to the bias voltage source within the supply 29. The chip U3 has terminals 14 and 16 interconnected and joined to the auxiliary driver 25 as described below. Terminal 13 with a grounded resistor-R57 is joined to the second driver U26 as described below. Terminals 8-12 extend to the alarm circuitry 27 as described below. Similarly, terminal 4 activats the alarm circuitry 27 through diode D36 as described below.

Extending from the terminal 12 of the chip U3 is a path to the transistor Q6 through a capacitor C7. The emitter of the transistor Q6 is grounded through a capacitor C8 and the base extends to the comparator 24 through a resistor R64. Terminal 9 of the chip U3 is connected to the collector of a transistor Q7 with a grounded emitter and a base connected to bias through a resistor R61 and a Zener diode D41. The plate terminal p-3 and the cathode terminal p-1 extend to the external alarm outputs 27E.

E. Indicator Circuitry

In order to provide an indication of the various operating conditions for the device 10 of FIG. 1, a bank 50 includes indicator diodes D6–D11, shown in FIG. 5. The light emitting diodes D6–D11 have respective grounding resistor R8 through R13. The gas detection light diodes D6 and D7 are associated with transistors Q1 and Q2, and the trouble detection light diode D10 is associated with both a transistor Q3 and a diode D18.

The diode D11 is a light emitting diode (LED) that signals "power-on" and normal stand-by circuit conditions. This diode is illuminated after being driven from the driver 32 of FIG. 3B by a comparator chip U2 at terminals 5 and 7 from an operational amplifier A1 within the chip U2 from a reference divider R33–R34. In addition, a signal appears on terminal 6 of the chip U2 driven by diodes D32 and D33 (adjoining the detector U3) through a steering diode D22 or a steering diode D18 (adjoining the indicator diode D11). The power-on LED D11 will be illuminated green when the power is on and during normal stand-by conditions, but is extinguished when there is a trouble or alarm condition.

F. Power Supply

With reference to FIG. 6, the power supply 60 for the detection and indication system 10 provides regulated voltages. In the specific embodiment of FIG. 6, two regulated voltages are supplied from a full wave, center-tapped bridge circuit 60-b through regulator chips 60-r1 and 60-r2.

The power supply 60 includes a transformer T1 with its primary winding shunted by a filter capacitor C2 and its secondary winding shunted by a bridge of rectifier diodes D12–D16. The full-wave rectified output of the bridge is applied to a regulator chip U8, which can be standard chip designated "78mo9" through a filter capacitor C3 in order to provide a first regulated direct-current voltage, for example +9 volts, which supplies all of the direct-current voltage required by the various components of the system 10.

A center tap on the transformer T1 is connected to a filter capacitor C1 which powers a limiter U7, for example a chip designated "Lm317", that operates in conjunction with resistors R16 and R17 to provide a regulated direct current voltage, for example, about 2.2 volts on a line carrying 400 milliampere to supply the heater current required by the system 10.

G. Operation of the System (1) Gas Detection

In order to achieve the detection of a hazardous gas condition, for example, caused by leak of a household gas such as methane or propane, a two catalytic detectors form adjoining arms of a detector bridge in the hazardous gas detection unit 21. Each catalytic unit produces a linear response and is formed by a platinum wire. Suitable catalytic units are obtainable from the Nemoto Company of Japan under the designation "NAP-7*a*". The remaining arms of the detector bridge are formed by resistors R3 and R4. Heater filaments are powered from the voltage regulator U7 in the power supply 27. Bridge balance and threshold adjustment are provided by series connected and tapped resistors R5, R6 and R7. The variable resistor R6 which interconnects fixed resistors R5 and R7 is fed by a voltage divider formed by resistors R31 and R32 within the main comparator 24 to apply a response signal at terminal 12 of the chip U1 and into terminal 13 through a capacitor C4 in order to connect to the opposite side of the bridge within the detector 21. In addition, hysteresis is provided in the comparator U1 by the connection of a large magnitude resistor R30 between terminals 13 and 14 of the chip U1.

Upon the sensing of a hydrocarbon gas, such as propane or methane, the temperature of the platinum catalyst in the units of detector 21 increases. This causes a change in resistance, which is a decrease for platinum, and the bridge balance is exceeded driving the internal amplifier A1-2 within the chip U1 to a high state at terminal 14. This causes the following results: (1) the high signal at terminal 14 of the chip U1 drives the transistor Q1 within the indicator circuitry 28 to an "on" state through a resistor R29 to activate the light emitting diode D6 to its "on" state through a resistor R8. During this time, the indicator diode D11 to signal an "okay" condition, is turned off. In addition, the emitter of the transistor Q1 drives the transistor Q6 in the alarm circuitry 29 to an "on" state through diodes D30 and D32 and base resistor R64. This places a timing capacitor C7 in operation. A further effect, through the diode D30, is to drive terminal 4 of the chip U4 to its high state through resistor R59.

Simultaneously, terminal 8 of the chip U4 is driven to its high state through a diode D38.

The chip U4 is a monostable pulse width generator for producing gas alarm and carbon monoxide alarm signals. The pulsewidths are determined by either resistor R59 or resistor R60 acting in conjunction with series connected capacitor C10. The pulse is synchronized with respect to the internal timing of the detector chip U3 by sampling at terminal 4 of the chip U3 through the diode D36 which is connected to capacitor C12 and resistor R58. A negative going needle pulse triggers the chip U4 which produces an output pulse at terminal 3 through the diode D40 to the buffer chip U2 at terminals 8 and 3. This, in turn, operates the detector chip U3 at terminal 13 from terminal 1 of the buffer chip U2.

For the gas alarm condition, the detector chip U3 produces a series of two audible dashes. Since the Underwriter's Laboratories require that heater filaments be monitored for open circuit conditions, this action takes place in the following way. In normal operation, the potential between the junction of the gas detecting units and the virtual ground created at the junction of the resistors R1 and R2 in the detector 21 is approximately 0. Failure of either sensor can result in a non-0, i.e., positive or negative potential in relation to the virtual ground. Accordingly, a commutator bridge formed by diodes D1 through D4 steers either positive potential through a diode D5 to the comparator chip U6 at terminal 9. A signal at terminal 8 is from the commutator bridge anode. Upon the detection of an open condition of either sensor heater, the comparator chip U6 at terminal 14 switches to a low voltage condition for the output of the main comparator chip U1 at terminal 14 through resistor R29. This ensures that no spurious gas alarm will sound. The comparator chip U1, at terminal 14, also acts upon the comparator chip U6 at terminal 1 and pulls it to a low voltage condition. This removes the drive signal on the transistor Q3 and causes illumination of the trouble detection light emitting diode D10. Current flowing through the resistors R18 and the diode D18 extinguishes the light diode D11 and drives the comparator chip U6 at terminal 13 to a high voltage state. This activates the enunciator driver chip U3 at terminal 13 during which time the transistor Q6 is inactive. The small time constant associated with the series connected capacitors C7 and C8 results in having the piezo horn sound a continuous string of audible dots.

(2) Carbon Monoxide Detection

To detect the presence of hazardous concentrations of carbon monoxide, a semiconductor sensor is employed for which a heater filament, extending between terminals 2 and 6, is driven by a current source. The latter is formed by a reference divider at terminals 4 and 5 of the comparator chip U1 and a scaler divider formed by resistors R25 and R26 at terminal 6 of comparator chip U1. The output appears at terminal 7 of the comparator chip U1 and is applied to a driver transistor Q4 which is connected through the heater pins 2 and 6 to a current limiting shunt resistor R65 for a transistor Q5. In the normal stand-by condition, the transistor Q5 is "off". A voltage divider is formed by the series combination of substrate pins 1, 3, 5 and 7, with pin 7 connected to an external balancing resistor R28. The comparator U1 samples the voltage of the carbon monoxide detector at terminal 3 through a resistor R27. The reference divider formed by resistors R21 and R22 appear at terminal 2. If a hazardous level of carbon monoxide appears at the detector, the substrate resistance falls causing a rise in voltage in excess of the comparator threshold. Terminal 1 of the comparator chip U1 goes high with the following effect. The transistor Q2 in the indicator 28 is turned on, supplying current to the carbon monoxide light emitting diode D7. The "okay" indicator diode D11 is turned off through diodes D31, D33 and D22 by the auxiliary driver chip U2. Diodes D31 and D33 extend from the anode of the carbon monoxide light emitting diode D7. The alarm chip U4 is then activated at terminals 7 and 8 through resistor R60 and diode D39 by way of the diode D31. This activation in turn activates the driver U3 at terminal 13 through diode D40, buffer chip U2 and diode D43. Finally, the relay K1 in the external alarm circuitry 29E also is activated.

The piezo horn in the alarm circuitry 29 sounds an alarm as a series of three audible dashes. Since semiconductor sensors can give spurious alarms if foreign gases accumulate on their surfaces, periodic heat cleansing is necessary to burn-off spurious gasses. For that purpose a bi-stable oscillator formed by chip U5 drives the transistor Q5 in the heat cleaning circuitry 22 through a resistor R53. The transistor Q5 by-passes the shunting current limiting resistor R65 and increases the current through the sensor heater for approximately one minute every hour. Since the Underwriter's laboratory requires the monitoring of heaters for an open circuit condition, a sample of heater voltage is obtained at pin 6 and applied to comparator U6 at terminal 5. This is compared with the voltage on the reference divider formed by resistors R35 and R36 applied to pin 4. Upon the occurrence of a "0" voltage condition, the internal amplifier A6-1 pulls the chip U1 at terminal 3 to a low voltage condition in order to prevent a false carbon monoxide alarm. At terminal 1 of chip U6, there is a low voltage because of a signal applied through diode D25. This illuminates the trouble indicator diode D10 and extinguishes the ok condition light diode D11.

It is to be noted that during heating cycle, the heater sampling point is pulled to a 0 voltage level. In order to suppress a false trouble detection alarm, a potential from the bistable oscillator chip U5 at terminal 3 is injected into the trouble detection comparator U6 at terminal 7 through a diode D26 to prevent tripping.

In addition, a test function switch SW-2 in the unit 21F is included for the carbon monoxide alarm. The switch SW-2 injects divider voltage from the tapped, series connected resistors R14 and R15 into the comparator chip U1 at terminal 3 which performs in the manner described above for the hazardous gas detection test.

(3) Smoke Detection

In order to provide smoke detection, the detector 23 employs a chip U3 which operates in conjunction with an ionization smoke chamber 23*s*. Such a chamber can take the form of the unit designated "NIS09" sold and marketed by the Nemoto Company of Japan. Internal timing for the detector chip U3 is set by a resistor R56 at terminals 6 and 7, which operates in either a rapid time constant or a long time constant mode. For the rapid time constant mode, the resistor R56 is joined to the series combination of capacitors C7 and C8 at terminal 12 of the detector U3. An illustrative rapid time constant is, for example, 0.03 seconds which applies during normal stand-by and trouble conditions. For the long time constant, the resistor R56 is connected the capacitor C7 and then through the grounded-emitter transistor Q6. This time constant applies during periods of gas, carbon monoxide, heat and smoke alarm conditions. The voltage in the detector chip U3 at terminals 14 and 16 decreases linearly in accordance with the volume of smoke detected in the chamber 23*s*.

The alarm threshold, normally performed internally by the integrated circuit U3 is detected by the integrated circuit U2 in the main comparator 24 through resistor R50 at terminal 9, and the threshold divider formed by resistors R51 and R52 at terminal 10.

A test function switch SW1, as required for Underwriters' Laboratory Approval, in the test assemblage 21T–23T when closed causes the quiescent voltage of the detector chip U3 at terminal 16 to drop to a level just below threshold, through a divider network formed by resistors R49 and R50 which are connected to terminal 9 of the auxiliary comparator chip U2. In either the test mode or the alarm mode the chip U2 at terminal 8 switches to a high voltage level and drives the smoke detection light emitting diode D9 to its "on" condition. Simultaneously, the signal level at terminal 9 of the chip U2 drives the internal buffer A3 at terminal 3 of the chip U2 through the diode D23. Within the chip U2, the amplifier A1 forms a buffer in conjunction with resistors R38 and R39 at terminal2. The output of the buffer A1 drives the detector chip U3 at terminal 13 through a diode D43 at terminal 1 of the chip U2 and a transistor Q6 in the smoke detector 23. The saturation voltage for the transistor Q6 is applied from terminal 1 of the chip U2 through a resistor R40 and a diode D42. Also driven by the smoke detection signal is an internal buffer amplifier A1-4 of the main comparator 24 at terminal 10 through the diode D42 and the resistor R40 which form a follower circuit. The output from the internal buffer A1-3 at terminals 8 and 9 of the chip U1 drives an alarm relay K1 in the external alarm output unit 29E. The diode D17 shunting the alarm relay K1 is a reverse voltage snubber. The ground return for the relay K1 extends through a diode D37 in the alarm circuitry 29 to a transistor Q7. The relay K1 is inoperative if the voltage is below a prescribed supply potential, for example, 8 volts.

Within the comparator chip U1, an internal amplifier A1-1 connected to terminal 1, drives a comparator in the chip U2 through the combination of diode D42, resistor R40 at terminal 1 and diode D22 at terminal 6. When the threshold of the divider formed by resistors R33 and R34 at terminal 5 of the chip U2 is reached, the output from the internal amplifier A2-4 reaches a low state and the light emitting diode D11 is extinguished. The enunciator piezo Horn then produces a continuous string of audible dashes.

Within the comparator chip U3 at terminal 9, the voltage from the transistor Q7 through resistor R61 and the diode D41 cause the detector chip U3 to be turned off when the supply voltage falls below a prescribed level in relation to the power supply direct current drive. Since the latter is illustratively positive 9 volts, the turnoff condition is on the order of positive 8 volts in order to suppress spurious alarm soundings if the alternating current input voltage falls below about 100 volts. This is in accordance with Underwriter's laboratory requirements.

(4) Heat Sensing

In order for the system 10 to be used for heat sensing, a precision temperature sensor is employed. A suitable sensor is a grounded Zener diode D44 which may be of the type "LM335". A regulated voltage from the power supply 27 is applied to the anode of the diode D44 through a current limiting resistor R69. In order to calibrate the sensor for ambient conditions, the diode D44 is shunted by a resistor R70 with an adjustable tap. When the output to the auxiliary comparator driver U2 at terminal 12 exceed the threshold established-at terminal 13 by a reference divider formed by resistors R67 and R68, the auxiliary comparator reaches a high voltage state at terminal 14. This produces the following results. The excessive-heat light-emitting diode D8 is driven to its "on" condition. The "ok" condition light diode D11 is turned off through diodes D31, D33 and D22 by the auxiliary comparator chip U2 at terminal 7. The transistor Q6 in the alarm circuitry 29 is turned "on" for selecting the long time constant of the capacitor C7 and the resistor R64 through the diodes D31 and D33. The horn driver chip U3 is activated at terminal 13 through a diode D40 by the driver U2 through diode D43 from pin 14 of chip U2. Relay K1 is energized from pin 8 of chip U1, and the piezo horn sounds an alarm as a continuous string of audible dashes.

(5) Alarm Operation

In order to provide a common source for alarm signals during the detection of any one of the multiple hazards within the capability of the system 10, the alarm circuitry 29 of FIG. 2i includes a universal detection chip U3, such as the chip "MC14467". Chip U3 drives a piezo horn enunciator 29*h*. Upon the occurrence of a trouble or an alarm condition, the horn 29*h* produces a sound signal that depends upon the condition that is detected.

It will be appreciated that the foregoing description is merely illustrative and that various adaptations and modifications of the invention may be made by those of ordinary skill in the art without departing from the scope of invention as defined in the appended claims.

What is claimed:

1. Apparatus for detecting a hazardous leakage of carbon oxide gases, which comprises a semiconductor sensor interconnecting driver and sink transistors;

said sink transistor extending to a heat cleaning unit;

said driver transistor being connected to a comparator and a bias voltage source; and said semiconductor sensor having an internal voltage divider and being joined to said bias source and said comparator.

2. Apparatus as defined in claim 1 for the detection of hazardous conditions associated with combustion or potential combustion, further comprising means for detecting a plurality of gaseous conditions having different chemical and thermal characteristics including said hazardous leakage of carbon dioxide gases; and means for indicating the presence of each such condition.

3. Apparatus as defined in claim 1 for periodic heat cleansing of said sensor, comprising a multi-terminal bistable oscillator connected to said sink transistor through a resistor, said oscillator is directly grounded and further connected to ground by a capacitor, and has other terminals interconnected by a diode, directly interconnected to said bias voltage source, and interconnected thereto by a resistor and diode.

4. Apparatus as defined in claim 1 for the detecting hazardous conditions including said hazardous leakage of carbon dioxide gases further comprising means for detecting spontaneously a plurality of said conditions and means for encoding a different response for each such condition.

5. Apparatus as defined in claim 4 wherein the detecting means comprises means for detecting leakage of fuel gases.

6. Apparatus as defined in claim 5 wherein said means for detecting leakage of fuel gases comprises a plurality of catalytic detector units, each having a platinum wire extending to a junction; a line extending from said junction to a comparator; resistive means for bridging said units to form a detector bridge; means for energizing said units and a further resistive shunt bridging said units to provide for bridge balance and threshold adjustment.

7. Apparatus as defined in claim 6 wherein said detector bridge is additionally shunted by a resistor within an auxiliary commutator bridge formed by diodes which are shunted by commutator resistors, and said commutator bridge acts through a steering diode with respect to a driver.

8. Apparatus as defined in claim 4 wherein the detecting means comprises means for detecting leakage of carbon oxide gases.

9. Apparatus as defined in claim 4 further including means for detecting smoky carbon particles.

10. Apparatus as defined in claim 9 wherein said means for detecting smoky carbon particles comprises an ionization chamber with a grounded cathode and a shield that is connected to a bias voltage power supply, and an anode connected to alarm circuitry.

11. Apparatus as defined in claim 4 further including means for detecting excess heating effects.

12. Apparatus as defined in claim 4 further including means for providing a distinctive audible alarm for each detected condition.

13. Apparatus as defined in claim 4 wherein timing for said alarm is controlled by a multiple-pin monostable pulse width generator chip, with one pin of said chip grounded and joined to another pin of said chip through a capacitor; a path from another pin of said chip extends to a comparator through a diode; another pin of said chip is connected to a pin of said chip through a resistor and to a detector chip through a capacitor; a pin of said chip is connected to another pin of said chip and paths extend through diodes to said comparator; said diodes are bridged to a pin of said chip by respective resistors; a pin of said chip is grounded through a capacitor; said chip serves multiple functions in the overall system and accordingly is active in conjunction with the gas and temperature sensing operations of the system, but with respect to smoke detection includes a timing resistor which interconnects terminals and is joined to a bias voltage source; said chip has terminals interconnected and joined to an auxiliary driver; a terminal with a grounded resistor is joined to a second driver; other terminals extend to alarm circuitry; extending from another terminal of said chip is a path to a transistor through a capacitor; the emitter of said transistor is grounded through a capacitor and its base extends to said comparator through a resistor; another terminal of said chip is connected to the collector of a second transistor with a grounded emitter and a base connected to bias through a resistor and a Zener diode; and plate and cathode terminals extend to external alarm outputs.

14. Apparatus for detecting a hazardous leakage of carbon oxide gases as defined in claim 1;

wherein said semiconductor sensor has a plurality of terminals and a filament within said sensor extends to a pair of said terminals which, in turn, interconnect said driver transistor and said sink transistor;

said sink transistor has a grounded emitter and is shunted to a collector by a current limiting resistor, with a base extending to said heat cleaning unit;

said collector extends to said driver transistor which has both an emitter and base connected to said comparator and a collector connected to said bias voltage source;

said semiconductor sensor further has a pair of interconnected terminals joined to said bias source and a still further pair of interconnected terminals extending to said comparator; and another of said terminals is joined to a resistor to complete an internal voltage divider of said semiconductor sensor.

15. The method of monitoring a hazard condition detector, which comprises the steps of:

monitoring for an overriddable open circuit condition by steering a signal through a commutator bridge to a comparator; and receiving said signal from said commutator bridge to detect said open circuit condition and switch said comparator to a low voltage condition to ensure that no spurious alarm will sound.

16. The method of claim 15 for detecting a hazardous condition, which further comprises detecting at least three different conditions and indicating the same.

17. The method of claim 16 for detecting a hazardous leak of a household gas such as methane or propane, comprising the steps of:

(a) producing a response by a catalytic unit in a bridge powered from a voltage regulator;

(b) achieving bridge balance and threshold adjustment for said catalytic unit;

(c) comparing said response signal with a reference; and (d) attaining hysteresis in a comparator by connecting a large magnitude resistor to said comparator.

18. The method of claim 17 for the sensing of a hydrocarbon gas, such as propane or methane, wherein the temperature of said catalytic unit increases causing a change in resistance and the bridge balance is exceeded to produce a high level state causing the high signal to drive a transistor within indicator circuitry to an "on" state through a resistor to activate a light emitting diode, and extinguish an indicator diode that signals an "okay" condition; the emitter of a transistor in alarm circuitry is driven to an "on" state through diodes and a base resistor placing a timing capacitor in operation; wherein said high state pulse is synchronized with respect to the internal timing of the detector by sampling with a negative going needle pulse that triggers a chip and produces an output pulse to operate said detector.

19. The method of claim 15, wherein an alarm condition produces a series of audible tones;

said overriddable open circuit condition is monitored by checking heater filaments in relation to virtual ground for a signal steered through said commutator bridge to said comparator; and said signal is received from said commutator bridge so that upon detection of an open circuit condition a short time constant will result in sounding an alternate series of audible tones.

20. The method of detecting a hazardous carbon dioxide condition, comprising the steps of monitoring for an open circuit condition;

comparing a monitored signal with that on a reference divider;

whereby the occurrence of a low level signal prevents a false carbon monoxide alarm, illuminates a trouble indicator and extinguishes an "OK" indicator;

wherein said low level signal suppresses a false trouble detection alarm by the injection of a potential from a bestial oscillator into a trouble detection comparator to prevent tripping;

operating in conjunction with an ionization smoke chamber having a set internal timing which operates in either a short time constant or a long time constant mode;

whereby for the short time constant mode, a resistor is joined to a series combination of capacitors which applies during normal stand-by and trouble conditions, and for the long time constant, said resistor is connected to a single capacitor and through a transistor during periods of gas, carbon monoxide, heat and smoke alarm conditions, with the signal in said detector decreasing linearly in accordance with the volume of smoke detected;

wherein upon detection of an alarm threshold, a threshold divider causes a quiescent signal to drop to a level just below threshold;

whereby in either the test mode or the alarm mode switching takes place to a high level signal to drive a smoke detection indicator to its "on" condition and simultaneously drive an internal buffer to saturation and produce an output which drives an external alarm; so that when the threshold of a divider formed by resistors is reached, the output from an internal amplifier reaches a low state and an "OK" indication is terminated and an enunciator produces a continuous string of audible sounds;

wherein detection is terminated when the supply voltage falls below a prescribed level in relation to the power supply direct current drive in order to suppress spurious alarm soundings if an alternating current input voltage falls; and providing a common enunciator source for alarm signals during the detection of any one of the multiple hazards within the capability of the system, the enunciator, upon the occurrence of an alarm condition, produces a signal that depends upon the condition that is detected.

* * * * *